US006874426B2

(12) United States Patent
Forbes

(10) Patent No.: US 6,874,426 B2
(45) Date of Patent: Apr. 5, 2005

(54) RAIL ROAD CAR TRUCK WITH BEARING ADAPTER AND METHOD

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 10/357,318

(22) Filed: Feb. 3, 2003

(65) Prior Publication Data

US 2004/0020403 A1 Feb. 5, 2004

Related U.S. Application Data

(63) Continuation-in-part of application No. 10/210,853, filed on Aug. 1, 2002.

(51) Int. Cl.[7] ..... B61F 5/00

(52) U.S. Cl. ..... 105/223; 105/218.1

(58) Field of Search ..... 105/157.1, 171, 105/174, 179, 182.1, 187, 190.1, 198, 206.1, 218.1, 218.2, 219, 220, 223

(56) References Cited

U.S. PATENT DOCUMENTS

| | | | | |
|---|---|---|---|---|
| 1,695,085 A | | 12/1928 | Cardwell | |
| 1,745,322 A | * | 1/1930 | Brittain | 105/221.1 |
| 1,855,903 A | * | 4/1932 | Brittain | 105/221.1 |
| 2,009,771 A | | 7/1935 | Goodwin | |
| 2,053,990 A | | 9/1936 | Goodwin | |
| 2,132,001 A | | 10/1938 | Dean | |
| 2,352,693 A | | 7/1944 | Davidson | |
| 2,404,278 A | | 7/1946 | Dath | |
| 2,434,583 A | | 1/1948 | Pierce | |
| 2,434,838 A | | 1/1948 | Cottrell | |
| 2,446,506 A | | 7/1948 | Barrett | |
| 2,551,064 A | | 5/1951 | Spenner | |
| 2,613,075 A | | 10/1952 | Barrett | |
| 2,669,943 A | | 2/1954 | Spenner | |
| 2,687,100 A | | 8/1954 | Dath | |
| 2,762,317 A | * | 9/1956 | Palmgren | 105/223 |
| 2,883,944 A | | 4/1959 | Couch | |
| 3,274,955 A | | 9/1966 | Thomas | |

(Continued)

FOREIGN PATENT DOCUMENTS

| | | |
|---|---|---|
| CA | 2090031 | 6/1991 |
| CA | 2153137 | 6/1995 |
| CA | 2191673 | 11/1996 |
| CH | 329987 | 5/1958 |
| EP | 1053925 A1 | 11/2000 |

OTHER PUBLICATIONS

1980 Car and Locomotive Cyclopedia, pp. 669–750. Section 13 Truck and Journal Bearings. pp. 669–682, 699–703, 706–709, 712–719, 722–726, 734–735.

1984 Car and Locomotive Cyclopedia, 5th ed. (Omaha: Simmons–Boardman Books, Inc. 1984) at pp. 512–513.

1997 Car and Locomotive Cyclopedia, 6th ed. (Omaha: Simmons–Boardman Books, Inc. 1997) at pp. 705–770. Section 7: Trucks, Wheels, Axles & Bearings. pp. 705–720, 724, 726, 735–736, 739–751.

(Continued)

*Primary Examiner*—Mark T. Le
(74) *Attorney, Agent, or Firm*—Hahn Loeser & Parks LLP; Michael H. Minns

(57) ABSTRACT

A swing motion rail road freight car truck is provided that has a truck bolster and a pair of side frames, the truck bolster being mounted transversely relative to the side frames. The side frames have spring seats for the groups of springs. The springs seats may be rigidly mounted in the side frames. Friction dampers are provided in inboard and outboard pairs. The biasing force on the dampers urges then to that act between the bolster ands and sideframes to resist parallelogram deflection of the truck. The bearing adapters and sideframe pedestal seats interact on a rolling linear contact interface that has a relatively small radius of curvature.

17 Claims, 15 Drawing Sheets

U.S. PATENT DOCUMENTS

| | | | | | |
|---|---|---|---|---|---|
| 3,285,197 | A | | 11/1966 | Tack | |
| 3,381,629 | A | * | 5/1968 | Jones | 105/218.1 |
| 3,461,814 | A | | 8/1969 | Weber et al. | |
| 3,670,660 | A | | 6/1972 | Weber et al. | |
| 3,699,897 | A | | 10/1972 | Sherrick | |
| 3,714,905 | A | * | 2/1973 | Barber | 105/198.4 |
| 3,920,231 | A | | 11/1975 | Harrison | |
| 3,965,825 | A | | 6/1976 | Sherrick | |
| 4,179,995 | A | * | 12/1979 | Day | 105/198.4 |
| 4,244,297 | A | | 1/1981 | Monselle | |
| 4,363,278 | A | | 12/1982 | Mulcahy | |
| 4,373,446 | A | | 2/1983 | Cope | |
| 4,590,864 | A | | 5/1986 | Przybylinski | |
| 5,009,521 | A | | 4/1991 | Wiebe | |
| 5,046,431 | A | | 9/1991 | Wagner | |
| 5,237,933 | A | | 8/1993 | Bucksbee | |
| 5,404,826 | A | * | 4/1995 | Rudibaugh et al. | 105/222 |
| 5,417,163 | A | | 5/1995 | Lienard | |
| 5,509,358 | A | | 4/1996 | Hawthorne | |
| 5,511,489 | A | | 4/1996 | Bullock | |
| 5,544,591 | A | * | 8/1996 | Taillon | 105/223 |
| 5,613,445 | A | * | 3/1997 | Rismiller | 105/224.1 |
| 5,735,216 | A | * | 4/1998 | Bullock et al. | 105/218.1 |
| 5,918,547 | A | * | 7/1999 | Bullock et al. | 105/218.1 |
| 6,142,081 | A | * | 11/2000 | Long et al. | 105/218.1 |
| 6,178,894 | B1 | * | 1/2001 | Leingang | 105/224.1 |
| 6,338,300 | B1 | | 1/2002 | Landrot | |
| 2003/0037696 | A1 | | 2/2003 | Forbes | |

OTHER PUBLICATIONS

1997 Car and Locomotive Cyclopedia, 6th ed. (Omaha: Simmons–Boardman Books, Inc. 1997) Section 7 Bearings. 817–822.

1997 Car and Locomotive Cyclopedia, 6th ed. (Omaha: Simmons–Boardman Books, Inc. 1997) at p. 834.

1966 Car and Locomotive Cyclopedia, 1st ed. (New York: Simmons–Boardman Publishing Corporation, 1966) at p. 827.

1970 Car and Locomotive Cyclopedia, 2nd ed. ((New York: Simmons–Boardman Publishing Corporation, 1970) at p. 816.

1984 Car and Locomotive Cyclopedia, 5th ed. (Omaha: Simmons–Boardman Books, Inc. 1984) at pp. 488, 489, 496, 500 and 526.

Nov. 1998 Railway Age, pp. 47, 51, 53, 62.

Sep. 1996, Rownd, K. et al., "Improved Ride Quality for Transportation of Finished Automobiles by Rail", Technology Digest TD 96–021, Association of American Railroads.

Sep. 1996, Rownd, K. et al., "Over–the–Road Tests Demonstrate Improved Ride Quality for Transportation of Finished Automobiles", Technology Digest TD 96–022. Association of American Railroads.

Sep. 1997, Burnett, S. et al., Improved Vehicle Dynamics Model for Tri–Level Auto–Rack Railcars, Technology Digest TD 97–038, Association of American Railroads.

Sep. 1997, Rownd, K. et al., "Improved Ride Quality for Rail Transport of Finished Automobiles", Technology Digest TD 97–039, Association of American Railroads.

Jun. 1998, Rownd, K. et al., "Use of Modified Suspensions to Improve Ride Quality in Bi–Level Auto–Racks", Technology Digest 98–014, Association of American Railroads.

Oct. 1998, Rownd, K. et al., "Improved Ride–Quality for Transportation of Finished Autos by Tri–Level Autorack", Technology Digest 98–025, Association of American Railroads.

Dec. 1998, Rownd, K. et al., "Advanced Suspensions Meet Performance Standards for Bi–Level Auto–Racks Cars", Technology Digest 98–032, Association of American Railroads.

Jun. 1999, Rownd, K. et al., "Advanced Suspensions Meet Ride–Quality Performance Standards for Tri–Level Auto–Rack Cars", Technology Digest 99–020, Association of American Railroads.

Jun. 1999, Rownd, K. et al., Evaluation of End–of–Car Cushioning Designs Using the TOES Model:, Technology Digest 99–019, Association of American Railroads.

Aug. 1999, Rownd, K. et al., "Improving the Economy of Bulk–Commodity Service Through Improved Suspensions", Technology Digest 99–027, Association of American Railroads.

Jul. 2000, Rownd, K. et al., "Improving the Economics of Bulk–Commodity Service: ASF Bulk Truck", Technology Digest 00–011, Association of American Railroads.

Jul. 2000, Rownd, K. et al., "Improving the Economics of Bulk–Commodity Service—S2E Standard Car Truck", Technology Digest 00–012, Association of American Railroads.

ASF Trucks "Good for the Long Run," American Steel Foundries, date unknown.

ASF User's Guide, "Freight Car Truck Design," American Steel Foundries, ASF652, date unknown.

ADAPTERPlus, Pennsy Corporation, Internet—PENNSY-.com, Ver. 9807, date unknown.

Barber S–2–D Product Bulletin, Undated.

Association of American Railroads Mechanical Division Manual of Standards and Recommended Practices Journal "Roller Bearing Adapters for Freight Cars", date Unknown, pp. H–35—H–42. Revised 1998.

Narrow Pedestal Side Frame Trucks, Timken Roller Bearing Company, date unknown.

Timken "AP" Bearing Assembly, Timken Roller Bearing Company, date unknown.

Buckeye XC–R VII, Buckeye Steel Castings, date unknown.

*Standard Car Truck Company, Truck Information Package 2000*: Iron Friction Wedge Replacement Guide, Standard Car Truck Company, 2000. Lifeguard Friction Wedge Replacement Guide, Standard Car Truck Company, 2000. TwinGuard Friction Wedge Replacement Guide, Standard Car Truck Company, 2000. Product Bulletin, Barber TwinGuard, Standard Car Truck Company, date unknown. Barber Split Wedge, Standard Car Truck Company, date unknown. Barber Split Wedge Replacement Guide, Standard Car Truck Company, 2000. Barber 905–SW Split Wedge Friction Casting, Standard Car Truck Company, 2000. Barber 905–SW Split Wedge Pocket Insert, Standard Car Truck Company, 2000. Barber 905–SW Split Wedge Insert Application Guide, Standard Car Truck Company, 2000.

*American Steel Foundries information*: Super Service Ridemaster, American Steel Foundries, date unknown. Motion Control M976 Upgrade Kit, source unknown, date unknown. ASF Motion Control Truck System with Super Service Ridemaster & D5 Springs, drawing no. AR–3421, ASF–Keystone, Inc., Jul. 14, 2003. Assembly ASF/Pennsy Adapter Plus Pad & Adapter, drawing no. 43317, ASF–Keystone, Inc., Jul. 10, 2003.

* cited by examiner

RAIL ROAD CAR TRUCK WITH BEARING ADAPTER AND METHOD

This Application is a continuation, in part, of my co-pending U.S. patent application Ser. No. 10/210,853 filed Aug. 1, 2002.

FIELD OF THE INVENTION

This invention relates to the field of rail road cars, and, more particularly, to the field of three piece rail road car trucks for rail road cars.

BACKGROUND OF THE INVENTION

Rail road cars in North America commonly employ double axle swivelling trucks known as "three piece trucks" to permit them to roll along a set of rails. The three piece terminology refers to a truck bolster and pair of first and second sideframes. In a three piece truck, the truck bolster extends cross-wise relative to the sideframes, with the ends of the truck bolster protruding through the sideframe windows. Forces are transmitted between the truck bolster and the sideframes by spring groups mounted in spring seats in the sideframes.

One general purpose of a resilient suspension system may tend to be to reduce force transmission to the car body, and hence to the lading. This may apply to very stiff suspension systems, as suitable for use with coal and grain, as well as to relatively soft suspension systems such as may be desirable for more fragile goods, such as tolls of paper, automobiles, shipping containers fruit and vegetables, and white goods.

One determinant of overall ride quality is the dynamic response to lateral perturbations. That is, when there is a lateral perturbation at track level, the rigid steel wheelsets of the truck may be pushed sideways relative to the car body. Lateral perturbations may arise for example from uneven track, or from passing over switches or from turnouts and other track geometry perturbations. When the train is moving at speed, the time duration of the input pulse due to the perturbation may be very short.

The suspension system of the truck reacts to the lateral perturbation. It is generally desirable for the force transmission to be relatively low. High force transmissibility, and corresponding high lateral acceleration, may tend not to be advantageous for the lading. This is particularly so if the lading includes relatively fragile goods. In general, the lateral stiffness of the suspension reflects the combined displacement of (a) the sideframe between (i) the pedestal bearing adapter and (ii) the bottom spring scat (that is, the sideframes swing laterally as a pendulum with the pedestal bearing adapter being the top pivot point for the pendulum); and (b) the lateral deflection of the springs between (i) the lower spring seat in the sideframe and (ii) the upper spring mounting against the underside of the truck bolster, and (c) the moment and the associated transverse shear force between the (i) spring seat in the sideframe and (ii) the upper spring mounting against the underside of the truck bolster.

In a conventional rail road car truck, the lateral stiffness of the spring groups is sometimes estimated as being approximately ½ of the vertical spring stiffness. Thus the choice of vertical spring stiffness may strongly affect the lateral stiffness of the suspension. The vertical stiffness of the spring groups may tend to yield a vertical deflection at the releasable coupler from the light car (i.e., empty) condition to the fully laden condition of about 2 inches. For a conventional grain or coal car subject to a 286,000 lbs., gross weight on rail limit, this may imply a dead sprung load of some 50,000 lbs., and a live sprung load of some 220,000 lbs., yielding a spring stiffness of 25–30,000 lbs./in., per spring group (there being, typically, two groups per truck, and two trucks per car). This may yield a lateral spring stiffness of 13–16,000 lbs./in per spring group. It should be noted that the numerical values given in this background discussion are approximations of ranges of values, and are provided for the purposes of general order-of-magnitude comparison, rather than as values of a specific truck.

The second component of stiffness relates to the lateral deflection of the sideframe itself. In a conventional truck, the weight of the sprung load can be idealized as a point load applied at the center of the bottom spring scat. That load is carried by the sideframe to the pedestal seat mounted on the bearing adapter. The vertical height difference between these two points may be in the range of perhaps 12 to 18 inches, depending on wheel size and sideframe geometry. For the general purposes of this description, for a truck having 36 inch wheels, 15 inches (+/−) might be taken as a roughly representative height.

The pedestal seat may typically have a flat surface that bears on an upwardly crowned surface on the bearing adapter. The crown may typically have a radius of curvature of about 60 inches, with the center of curvature lying below the surface (i.e., the surface is concave downward).

When a lateral shear force is imposed on the springs, there is a reaction force in the bottom spring seat that will tend to deflect the sideframe, somewhat like a pendulum. When the sideframe takes on an angular deflection in one direction, the line of contact of the flat surface of the pedestal seat with the crowned surface of the bearing adapter will tend to move along the are of the crown in the opposite direction. That is, if the bottom spring seat moves outboard, the line of contact will tend to move inboard. This motion is resisted by a moment couple due to the sprung weight of the car on the bottom spring seat, acting on a moment arm between (a) the line of action of gravity at the spring seat and (b) the line of contact of the crown of the bearing adapter. For a 286,000 lbs. car the apparent stiffness of the sideframe may be of the order of 18,000~25,000 lbs./in, measured at the bottom spring seat. That is, the lateral stiffness of the sideframe (i.e., the pendulum action by itself) can be greater than the (already relatively high) lateral stiffness of the spring group in shear, and this apparent stiffness is proportional to the total sprung weight of the car (including lading). When taken as being analogous to two springs in series, the overall equivalent lateral spring stiffness may be of the order of 8,000 lbs./in. to 10,000, per sideframe. A car designed for lesser weights may have softer apparent stiffness. This level of stiffness may not always yield as smooth a ride as may be desired.

There is another component of spring stiffness due to the unequal compression of the inside and outside portions of the spring group as the bottom spring seat rotates relative to the upper spring group mount under the bolster. This stiffness, which is additive to (that is, in parallel with) the stiffness of the sideframe, can be significant, and may be of the order of 3000–3500 lbs./in per spring group, depending on the stiffness of the springs and the layout of the group. Other second and third order effects are neglected for the purpose of this description. The total lateral stiffness for one sideframe, including the spring stiffness, the pendulum stiffness and the spring moment stiffness, for a S2HD 110 Ton truck may be about 9200 lbs/inch per side frame.

It has been observed that it may be preferable to have springs of a given vertical stiffness to give certain vertical ride characteristics, and a different characteristic for lateral perturbations. In particular, a softer lateral response may be desired at high speed (greater than about 50 m.p.h) and relatively low amplitude to address a truck hunting concern, while a different spring characteristic may be desirable to address a low speed (roughly 10–25 m.p.h) roll characteristic, particularly since the overall suspension system may have a roll mode resonance lying in the low speed regime.

An alternate type of three piece truck is the "swing motion" truck. One example of a swing motion truck is shown at page 716 in the 1980 *Car and Locomotive Cyclopedia* (1980, Simmons-Boardmnan, Omaha). This illustration, with captions removed, is the basis of FIGS. 1*a*, 1*b* and 1*c*, herein, labelled "Prior Art". Since the truck has both lateral and longitudinal axes of symmetry, the artist has only shown half portions of the major components of the truck. The particular example illustrated is a swing motion truck produced by National Castings Inc., more commonly referred to as "NACO". Another example of a NACO Swing Motion truck is shown at page 726 of the 1997 *Car and Locomotive Cyclopedia* (1997, Simmons-Boardroom, Omaha). An earlier swing motion three piece truck is shown and described in U.S. Pat. No. 3,670,660 of Weber et al., issued Jun. 20, 1972, the specification of which is incorporated herein by reference.

In a swing motion truck, the sideframe is mounted as a "swing hanger" and acts much like a pendulum. In contrast to the truck described above, the bearing adapter has an upwardly concave rocker bearing surface, having a radius of curvature of perhaps 10 inches and a center of curvature lying above the bearing adapter. A pedestal rocker seat nests in the upwardly concave surface, and has itself an upwardly concave surface that engages the rocker bearing surface. The pedestal rocker seat has a radius of curvature of perhaps 5 inches, again with the center of curvature lying upwardly of the rocker.

In this instance, the rocker seat is in dynamic rolling contact with the surface of the bearing adapter. The upper rocker assembly tends to act more like a hinge than the shallow crown of the bearing adapter described above. As such, the pendulum may tend to have a softer, perhaps much softer, response than the analogous conventional sideframe. Depending on the geometry of the rocker, this may yield a sideframe resistance to lateral deflection in the order of ¼ (or less) to about ½ of what might otherwise be typical. If combined in series with the spring group stiffness, it can be seen that the relative softness of the pendulum may tend to become the dominant factor. To some extent then, the lateral stiffness of the truck becomes less strongly dependent on the chosen vertical stiffness of the spring groups at least for small displacements. Furthermore, by providing a rocking lower spring seat, the swing motion truck may tend to reduce, or eliminate, the component of lateral stiffness that may tend to arise because of unequal compression of the inboard and outboard members of the spring groups, thus further softening the lateral response.

In the truck of U.S. Pat. No. 3,670,660 the rocking of the lower spring seat is limited to a range of about 3 degrees to either side of center, and a transom extends between the sideframes, forming a rigid, unsprung, lateral connecting member between the rocker plates of the two sideframes. In this context, "unsprung" refers to the transom being mounted to a portion of the truck that is not resiliently isolated from the rails by the main spring groups.

When the three degree condition is reached, the rockers "lock-up" against the side frames, and the dominant lateral displacement characteristic is that of the main spring groups in shear, as illustrated and described by Weber. The lateral, unsprung, sideframe connecting member, namely the transom, has a stop that engages a downwardly extending abutment on the bolster to limit lateral travel of the bolster relative to the sideframes. This use of a lateral connecting member is shown and described in U.S. Pat. No. 3,461,814 of Weber, issued Mar. 7, 1967, also incorporated herein by reference. As noted in U.S. Pat. No. 3,670,660 the use of a spring plank had been known, and the use of an abutment at the level of the spring plank tended to permit the end of travel reaction to the truck bolster to be transmitted from the sideframes at a relatively low height, yielding a lower overturning moment on the wheels than if the end-of-travel force were transmitted through gibs on the truck bolster from the sideframe columns at a relatively greater height. The use of a spring plank in this way was considered advantageous.

In Canadian Patent 2,090,031, (issued Apr. 15, 1997 to Weber et al.,) noting the advent of lighter weight, low deck cars, Weber et al., replaced the transom with a lateral rod assembly to provide a rigid, unsprung connection member between the platforms of the rockers of the lower spring seats. One type of car in which relative lightness and a low main deck has tended to be found is an Autorack car.

For the purposes of rapid estimation of truck lateral stiffness, the following formula can be used:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pure pendulum, the relationship between weight and deflection is approximately linear for small angles of deflection, such that, by analogy to a spring in which F=kx, a lateral constant (for small angles) can be defined as $k_{pendulum}=W/L$, where k is the lateral constant, W is the weight, and L is the pendulum length. Further, for the purpose of rapid comparison of the lateral swinging of the sideframes, an approximation for an equivalent pendulum length for small angles of deflection can be defined as $L_{eq}=W/k_{pendulum}$. In this equation W represents the sprung weight borne by that sideframe, typically ¼ of the total sprung weight for a symmetrical car. For a conventional truck, $L_{eq}$ may be of the order of about 3 or 4 inches. For a swing motion truck, $L_{eq}$ may be of the order of about 10 to 15 inches.

It is also possible to define the pendulum lateral stiffness (for small angles) in terms of the length of the pendulum, the radius of curvature of the rocker, and the design weight carried by the pendulum: according to the formula:

$$k_{pendulum}=(F_{lateral}/\delta_{lateral})=(W/L_{pendulum})[(R_{curvature}/L_{pendulum})+1]$$

where:

$k_{pendulum}$=the lateral stiffness of the pendulum $F_{lateral}$=the force per unit of lateral deflection $\delta_{lateral}$=a unit of lateral deflection W=the weight borne by the pendulum $L_{pendulum}$=the length of the pendulum, being the vertical distance from the contact surface of the bearing adapter to the bottom spring seat $R_{curvature}$=the radius of curvature of the rocker surface Following from this, if the pendulum stiffness is taken in series with the lateral spring stiffness, then the resultant overall lateral stiffness can be obtained. Using this number in the denominator, and the design weight in the numerator yields a length, effectively equivalent to a pendulum length if the entire lateral stiffness came from an equivalent pendulum according to $L_{resultant}=W/k_{lateral\ total}$ For a conventional truck with a 60 inch radius of curvature rocker, and stiff suspension, this length, $L_{resultant}$ may be of the order of 6–8 inches, or thereabout.

So that the present invention may better be understood by comparison, in the prior art illustration of FIGS. 1*a*, 1*b*, and 1*c*, a NACO swing motion truck is identified generally as A20. Inasmuch as the truck is symmetrical about the truck center both from side-to-side and lengthwise, the artist has shown only half of the bolster, identified as A22, and half of one of the sideframes, identified as A24.

In the customary manner, sideframe A24 has defined in it a generally rectangular window A26 that admits one of the ends of the bolster A28. The top boundary of window A26 is defined by the sideframe arch, or compression member identified as top chord member A30, and the bottom of window A26 is defined by a tension member, identified as bottom chord A32. The fore and aft vertical sides of window A26 are defined by sideframe columns A34.

At the swept up ends of sideframe A24 there are sideframe pedestal fittings A38 which each accommodate an upper rocker identified as a pedestal rocker seat A40, that engages the upper surface of a bearing adapter A42. Bearing adapter A42 itself engages a bearing mounted on one of the axles of the truck adjacent one of the wheels, A rocker seat A40 is located in each of the fore and aft pedestals, the rocker seats being longitudinally aligned such that the sideframe can swing transversely relative to the rolling direction of the truck A20 generally in what is referred to as a "swing hanger" arrangement.

The bottom chord of the sideframe includes pockets A44 in which a pair of fore and aft lower rocker bearing seats A46 are mounted. The lower rocker seat A48 has a pair of rounded, tapered ends or trunnions A50 that sit in the lower rocker bearings A48, and a medial platform A52. An array of four corner bosses A54 extend upwardly from platform A52.

An unsprung, lateral, rigid connecting member in the nature of a spring plank, or transom A60 extends cross-wise between the sideframes in a spaced apart, underslung, relationship below truck bolster A22. Transom A60 has an end portion that has an array of four apertures A62 that pick up on bosses A54. A grouping, or set of springs A64 seats on the end of the transom, the corner springs of the set locating above bosses A54.

The spring group, or set A64, is captured between the distal end of bolster A22 and the end portion of transom A60. Spring set A64 is placed under compression by the weight of the rail car body and lading that bears upon bolster A22 from above. In consequence of this loading, the end portion of transom A60, and hence the spring set, are carried by platform A54. The reaction force in the springs has a load path that is carried through the bottom rocker A70 (made up of trunnions A50 and lower rocker bearings A48) and into the sideframe A22 more generally.

Friction damping is provided by damping wedges A72 that seat in mating bolster pockets A74. Bolster pockets A74 have inclined damper seats A76. The vertical sliding faces of the friction damper wedges then ride up an down on friction wear plates A80 mounted to the inwardly facing surfaces of the sideframe columns.

The "swing motion" truck gets its name from the swinging motion of the sideframe on the upper rockers when a lateral track perturbation is imposed on the wheels. The reaction of the sideframes is to swing, rather like pendula, on the upper rockers. When this occurs, the transom and the truck bolster tend to shift sideways, with the bottom spring seat platform rotating on the lower rocker.

The upper rockers are inserts, typically of a hardened material, whose rocking, or engaging, surface A80 has a radius of curvature of about 5 inches, with the center of curvature (when assembled) lying above the upper rockers (i.e., the surface is upwardly concave).

As noted above, one of the features of a swing motion truck is that while it may be quite stiff vertically, and while it may be resistant to parallelogram deformation because of the unsprung lateral connection member, it may at the same time tend to be laterally relatively soft.

SUMMARY OF THE INVENTION

In one aspect of the present invention there is a bearing adapter having an upwardly facing crown for engaging a bearing surface mounted in the pedestal seat of a side frame of a three-piece railroad car truck. The upwardly facing crown has a radius of curvature of less the 30 inches.

In another feature of the invention, the upwardly facing crown has a radius of curvature in the range of 3 to 24 inches. In another feature of the invention, the upwardly facing crown has a radius in the range of 4 to 15 inches. In another feature of the invention, the crown has a radius of curvature in the range of 4 to 10 inches. In another feature of the invention, the radius of curvature is in the range of 4 to 6 inches. In another feature of the invention, the radius is in about 5 inches.

In another aspect of the invention, there is a method of retro-fitting a three piece rail road car truck comprising the steps of (a) removing an existing bearing adapter; (b) replacing the existing bearing adapter with a replacement bearing adapter having an upwardly facing crown for contacting an existing bearing seat, the crown of the replacement bearing adapter has a radius of curvature of less than 30 inches.

In an additional feature of the invention, the step of replacing the existing bearing adapter includes installing a replacement bearing adapter having a crown radius of curvature of less than 24 inches. In an additional feature of the invention the step of replacing the existing bearing adapter includes installing a replacement bearing adapter having a crown radius of curvature of less than 15 inches. In an additional feature of the invention, the step of replacing the existing bearing adapter includes installing a replacement bearing adapter having a crown radius of curvature in the range of 3 to 10 inches. In an additional feature of the invention, the step of replacing the existing bearing adapter includes installing a replacement bearing adapter having a crown radius of curvature in the range of 4 to 6 inches. In an additional feature of the invention, the step of replacing the existing bearing adapter includes installing a replacement bearing adapter having a crown radius of curvature of about 5 inches.

In another additional feature, the method includes the step of widening the lateral travel range of the truck bolster relative to the sideframe. In another additional feature of the invention, the step of widening includes the step of removing at least one existing gib, and installing one of (a) said gib and (b) a new replacement gib, in a position allowing greater lateral travel of said truck bolster than formerly.

In another additional feature, the method includes the step of widening the lateral travel range of the truck bolster relative to the side frame by removing existing inboard and outboard gibs, and installing new, more widely spaced inboard and outboard gibs. In another additional feature of the invention, the step of widening includes the step of allowing at least 1" travel to either side of a central position of said truck bolster relative to said side frame. In another additional feature of the invention, the step of widening includes the step of allowing at least 1¼ inches of lateral travel to either side of a central position.

In another feature, the method includes the step of replacing the existing truck bolster with a new truck bolster having damper pockets arranged to permit a four-cornered damper arrangement, and includes the step of providing four dampers for said four-cornered arrangement. In an additional feature, said method includes the step of widening the side frame column bearing surfaces to accommodate a four-cornered damper arrangement.

In yet another additional feature, the truck is free of unsprung lateral bracing between the sideframes. In still another additional feature, the truck is free of a transom, In still yet another additional feature, each of the sideframes has a rigid spring seat, and respective groups of springs are mounted therein between the spring seat and a respective end of the truck bolster. In still another additional feature, each of the friction dampers are sprung on springs of the spring groups. In a further additional feature, each of the sideframes has a rocking spring seat. In still a further additional feature, each of the sideframes has an equivalent pendulum length, $L_{eq}$, in the range of 6 to 15 inches.

In yet a further additional feature, a first spring group is mounted between the first end of the truck bolster and the first side frame. A second spring group is mounted between the second end of the truck bolster and the second side frame. Each of the first and second spring groups has a vertical spring rate constant k that is in the range of 12,000 to 18,000 Lbs./in per group.

In another aspect of the invention there is a swing motion rail road car truck. The truck has a truck bolster having a first end and a second end and a pair of first and second sideframes. Each of the sideframes accommodates an end of the truck bolster, and has a spring seat for receiving a spring group. The truck has a first spring group and a second spring group. The first spring group is mounted in the spring seat of the first sideframe. The second spring group is mounted in the spring seat of the second sideframe. The truck bolster is mounted cross-wise relative to the sideframes. The first end of the truck bolster is supported by the first spring group. The second end of the truck bolster is supported by the second spring group. The first and second sideframes each have swing hanger rocker mounts for engaging first and second axles. The rocker mounts are operable to permit cross-wise swinging motion of the sideframes. The truck is free of lateral cross-bracing between the sideframes. In an additional feature of that aspect of the invention, the spring seats are rigidly mounted to the sideframes.

In another additional feature, a set of biased members, operable to resist parallelogram deformation of the truck, is mounted to act between each end of the truck bolster and the sideframe associated therewith. One of the sets of biased members includes first and second biased members. The first biased member is mounted to act at a laterally inboard location relative to the second biased member. In still another additional feature, each of the sets of biased members includes third and fourth biased members. The third biased member is mounted transversely inboard of the fourth biased member. In yet another additional feature, the biased members are friction dampers.

In still yet another additional feature, a set of friction dampers is mounted to act between each end of the truck bolster and the sideframe associated therewith. One of the sets of friction dampers includes first and second friction dampers. The first friction damper is mounted to act at a laterally inboard location relative to the second friction damper. In another additional feature, each of the sets of friction dampers includes third and fourth friction dampers. The third friction damper is mounted transversely inboard of the fourth friction damper. In a further additional feature, the friction dampers are individually biased by springs of the spring groups. In still a further additional feature, each of the side frames has an equivalent pendulum length $L_{eq}$ in the range of 6 to 15 inches. In yet a further additional feature, each of the spring groups has a vertical spring rate constant of less than 15,000 Lbs./in.

In still yet a further additional feature, a first set of friction dampers is mounted to act between the first end of the truck bolster and the first sideframe. A second set of friction dampers is mounted to act between the second end of the truck bolster and the second sideframe. The first set of friction dampers includes at least four individually sprung friction dampers. In another additional feature, the friction dampers are mounted in a four corner arrangement. In yet another additional feature, the friction dampers include a first inboard friction damper, a second inboard friction damper, a first outboard friction damper and a second outboard friction damper. The first and second inboard friction dampers are mounted transversely inboard relative to the first and second outboard friction dampers.

In still yet another additional feature, each of the sideframes has a rigid spring seat, and respective groups of springs are mounted therein between the spring seat and a respective end of the truck bolster. In a further additional feature, each of the friction dampers are sprung on springs of the spring groups. In still a further additional feature, each of the sideframes has a rocking spring seat. In yet a further additional feature, each of the sideframes has an equivalent pendulum length, $L_{eq}$, in the range of 6 to 15 inches. In still yet a further additional feature, each of the first and second spring groups has a vertical spring rate constant k that is less than 15,000 Lbs./in per group.

BRIEF DESCRIPTION OF THE ILLUSTRATIONS

The principles of the invention may better be understood with reference to the accompanying figures provided by way of illustration of an exemplary embodiment, or embodiments, incorporating those principles, and in which:

FIG. 1*a* shows a prior art exploded partial view illustration of a swing motion truck based on the illustration shown at page 716 in the 1980 *Car and Locomotive Cyclopedia;*

FIG. 1*b* shows a cross-sectional detail of an upper rocker assembly of the truck of FIG. 1*a;*

FIG. 1*c* shows a cross-sectional detail of a lower rocker assembly of the truck of FIG. 1*a;*

FIG. 2*a* shows a swing motion truck as shown in FIG. 1*a*, but lacking a transom;

FIG. 2*b* shows a sectional detail of an upper rocker assembly of the truck of FIG. 2*a;*

FIG. 2*c* shows a cross-sectional detail of a bottom spring seat of the truck of FIG. 2*a;*

FIG. 3*a* shows a swing motion truck having an upper rocker as in the swing motion truck of FIG. 1*a*, but having a rigid spring seat, and being free of a transom;

FIG. 3*b* shows a cross-sectional detail of the upper rocker assembly of the truck of FIG. 3*a;*

FIG. 4 shows a swing motion truck similar to that of FIG. 3*a*, but having doubled bolster pockets and wedges;

FIG. 5*a* shows an isometric view of an assembled swing motion truck similar to that of FIG. 3*a*, but having a different spring and damper arrangement;

FIG. 5*b* shows a top view of the truck of FIG. 5*a* showing a 2×4 spring arrangement;

FIG. 5*c* shows the damper arrangement of the truck of FIG. 5*a;*

FIG. 5*d* shows a side view of the truck of FIG. 5*a;*

FIG. 6*a* shows an alternate bearing adapter for a rail road car truck such as that of FIG. 2*a*, 3*a*, 4, 5*a* or 7*a* (below);

FIG. 6*b* shows a profile of the bearing adapter of FIG. 6*a;*

FIG. 6*c* shows an alternate profile for a bearing adapter as in FIG. 6*a;*

FIG. 6*d* shows a further alternate profile for a bearing adapter as shown in FIG. 6*a;*

FIG. 6*e* shows an alternate installation of bearing adapter;

FIG. 6*f* shows a general installation relationship of any of the bearing adapter embodiments of FIGS. 6*a* to 6*e;*

FIG. 7*a* shows an isometric view of an alternate railroad car truck to that of FIG. 5*a;*

FIG. 7*b* shows a side view of the three piece truck of FIG. 7*a;*

FIG. 7*c* shows a top view of the three piece truck of FIG. 7*a;*

FIG. 7*d* shows an end view of the three piece truck of FIG. 7*a;*

FIG. 7*e* shows a schematic of a spring layout for the truck of FIG. 7*a;*

DETAILED DESCRIPTION OF THE INVENTION

Figures 1A, 1B, 1C:
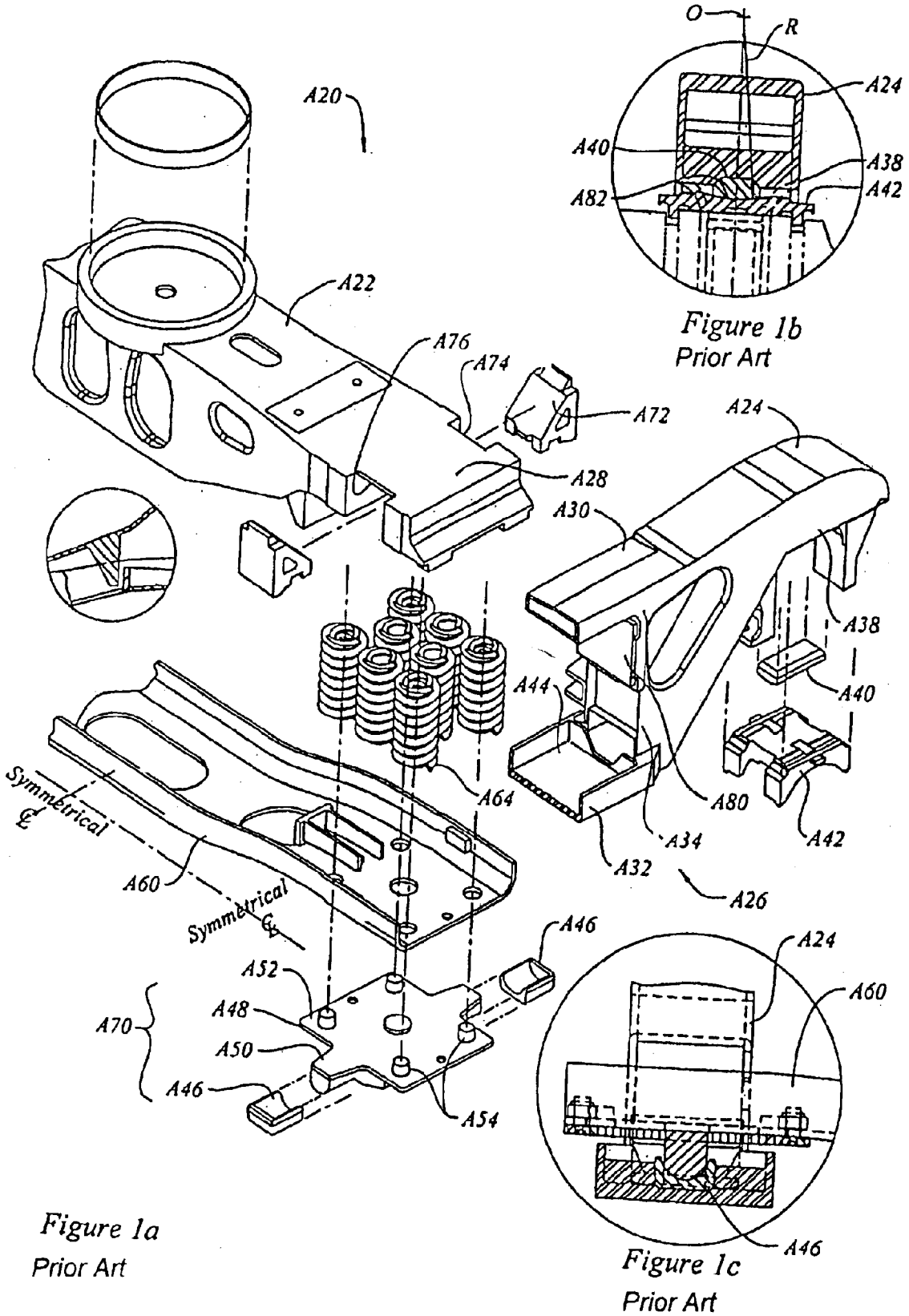
Figure 1b Prior Art
Figure 1a Prior Art
Figure 1c Prior Art

The description that follows, and the embodiments described therein, are provided by way of illustration of an example, or examples, of particular embodiments of the principles of the present invention. These examples are provided for the purposes of explanation, and not of limitation, of those principles and of the invention, In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road car trucks described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis.

This description relates to rail car trucks. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail of 142,000 lbs. Similarly, "50 Ton" corresponds to 177,000 lbs, "70 Ton" corresponds to 220,000 lbs, "100 Ton" corresponds to 263, 000 lbs, and "125 Ton" corresponds to 315,000 lbs, In each case the load limit per truck is then half the maximum gross car weight on rail. A "110 Ton" truck is a term sometimes used for a truck having a maximum weight on rail of 286,000 lbs.

This application refers to friction dampers, and multiple friction damper systems. There are several types of damper arrangement as shown at pages 715–716 of the 1997 *Car and Locomotive Encyclopedia*, those pages being incorporated herein by reference. Double damper arrangements are shown and described in my co-pending U.S. patent application, filed contemporaneously herewith and entitled "Rail Road Freight Car With Damped Suspension" which is also incorporated herein by reference. Each of the arrangements of dampers shown at pp. 715 to 716 of the 1997 *Car and Locomotive Encyclopedia* can be modified according to the principles of my aforesaid co-pending application for "Rail Road Freight Car With Damped Suspension" to employ a four cornered, double damper arrangement of inner and outer dampers.

Figures 2A, 2B, 2C:
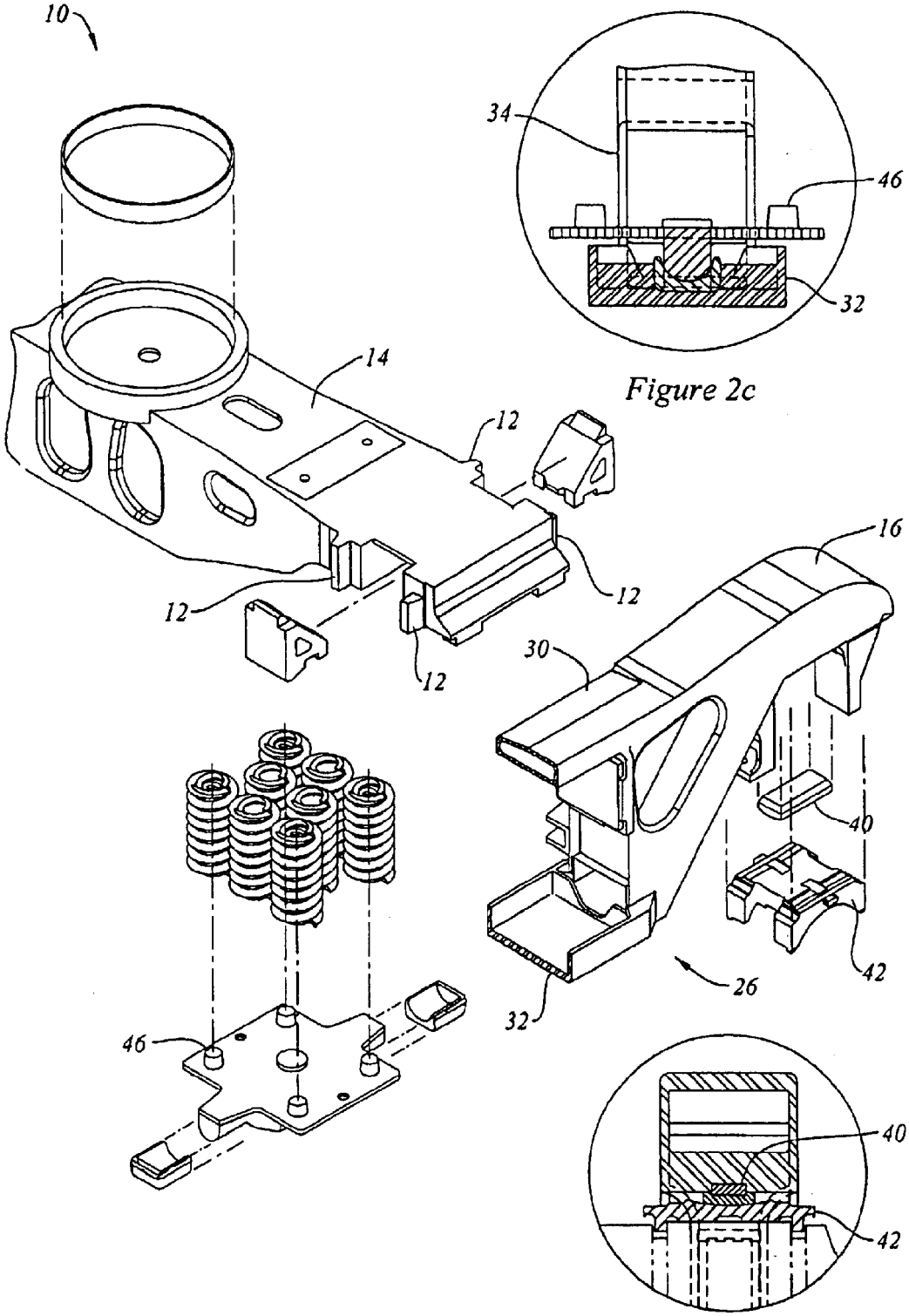

In the example of FIGS. 2*a* and 2*b*, a truck embodying an aspect of the present invention is indicated as 10. Truck 10 differs from truck A20 of FIG. 1*a* insofar as it is free of a rigid, unsprung lateral connecting member in the nature of unsprung cross-bracing such as a frame brace of crossed-diagonal rods, lateral rods, or a transom (such as transom A60) running between the rocker plates of the bottom spring seats of the opposed sideframes. Further, truck 10 employs gibs 12 to define limits to the lateral range of travel of the truck bolster 14 relative to the sideframe 16. In other respects, including the sideframe geometry and upper and lower rocker assemblies, truck 10 is intended to have generally similar features to truck A20, although it may differ in size, pendulum length, spring stiffness, wheelbase, window width and window height, and damping arrangement. The determination of these values and dimensions may depend on the service conditions under which the truck is to operate.

As with other trucks described herein, it will be understood that since truck 10 (and trucks 20, 120, and 220, described below) are symmetrical about both their longitudinal and transverse axes, the truck is shown in partial section. In each case, where reference is made to a sideframe, it will be understood that the truck has first and second sideframes, first and second spring groups, and so on.

Figures 3A, 3B:
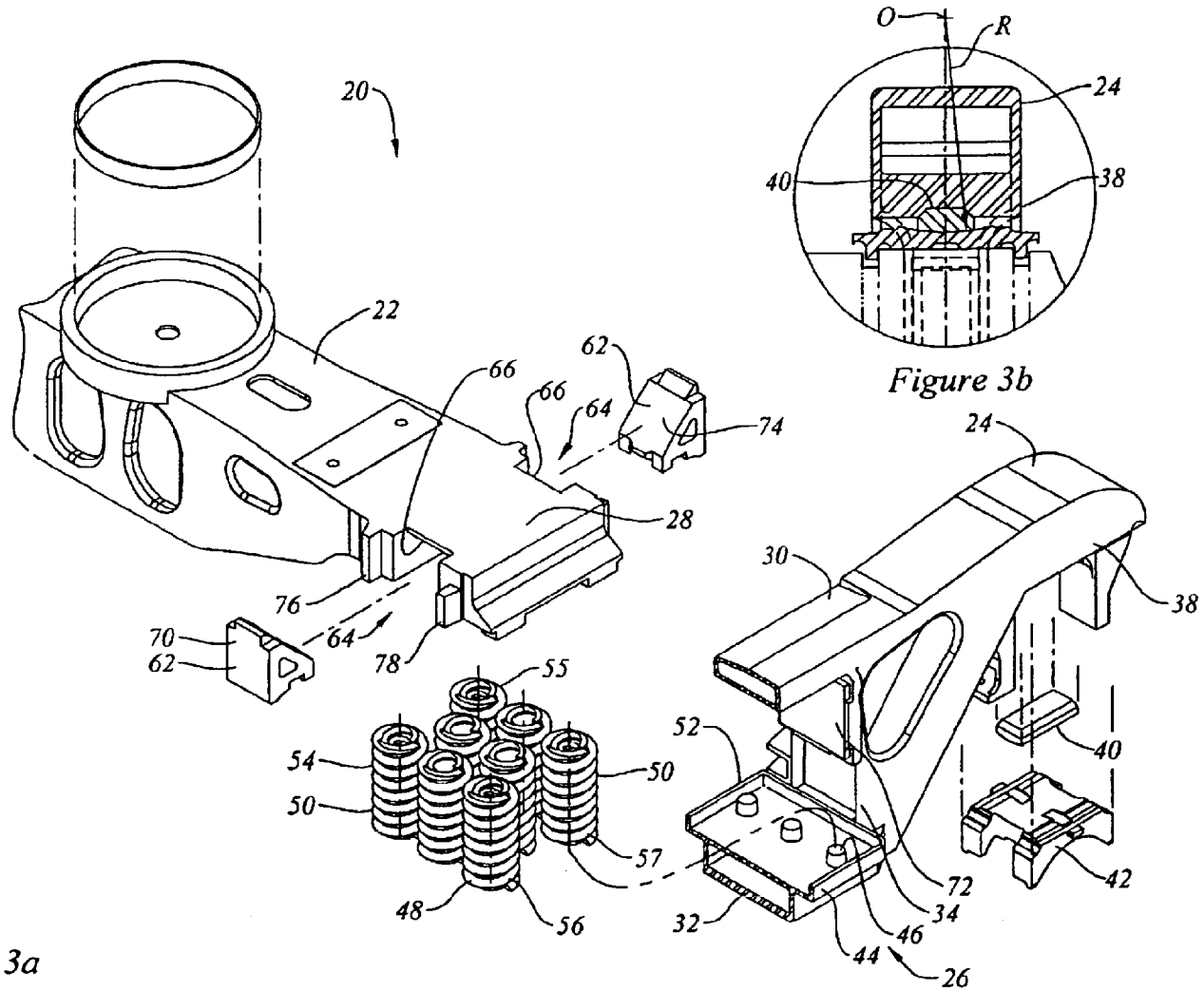

In FIGS. 3*a* and 3*b*, for example, a truck embodying an aspect of the present invention is identified generally as 20. Inasmuch as truck 20 is symmetrical about the truck center both from side-to-side and lengthwise, the bolster, identified as 22, and the sideframes, identified as 24 are shown in part.

Truck 20 differs from truck A20 of the prior art, described above, in that truck 20 has a rigid spring seat rather than a lower rocker as in truck A20, as described below, and is free of a rigid, unsprung lateral connection member such as an underslung transom A60, a frame brace, or laterally extending rods.

Sideframe 24 has a generally rectangular window 26 that accommodates one of the ends 28 of the bolster 22. The upper boundary of window 26 is defined by the sideframe arch, or compression member identified as top chord member 30, and the bottom of window 26 is defined by a tension member identified as bottom chord 32. The fore and aft vertical sides of window 26 are defined by sideframe columns 34.

The ends of the tension member sweep up to meet the compression member. A each of the swept-up ends of sideframe 24 there are sideframe pedestal fittings 38. Each fitting 38 accommodates an upper rocker identified as a pedestal rocker seat 40. Pedestal rocker seat 40 engages the upper surface of a bearing adapter 42. Bearing adapter 42 engages a bearing mounted on one of the axles of the truck adjacent one of the wheels. A rocker seat 40 is located in each of the fore and aft pedestal fittings 38, the rocker seats 40 being longitudinally aligned such that the sideframe can swing transversely relative to the rolling direction of the truck in a "swing hanger" arrangement.

Bearing adapter 42 has a hollowed out recess 43 in its upper surface that defines a bearing surface 43 for receiving rocker seat 40. Bearing surface 43 is formed on a radius of curvature $R_1$. The radius of curvature $R_1$ is preferably in the range of less than 25 inches, and is preferably in the range of 8 to 12 inches, and most preferably about 10 inches with the center of curvature lying upwardly of the rocker seat. The lower face of rocker seat 40 is also formed on a circular arc, having a radius of curvature $R_2$ that is less than the radius of curvature $R_1$ of recess 43, $R_2$ is preferably in the range of ¼ to ¾ as large as $R_1$, and is preferably in the range of 3–10 inches, and most preferably 5 inches when $R_1$ is 10 inches, i.e., $R_2$ is one half of $R_1$. Given the relatively small angular displacement of the rocking motion of $R_2$ relative to $R_1$ (typically less than +/−10 degrees) the relationship is one of rolling contact, rather than sliding contact.

The bottom chord or tension member of sideframe 24 has a basket plate, or lower spring seat 44 rigidly mounted to bottom chord 32, such that it has a rigid orientation relative to window 26, and to sideframe 24 in general. That is, in contrast to the lower rocker platform of the prior art swing motion truck A20 of FIG. 1*a*, as described above, spring seat 44 is not mounted on a rocker, and does not rock relative to sideframe 24. Although spring seat 44 retains an array of bosses 46 for engaging the corner elements 54, namely springs 54 and 55 (inboard), 56 and 57 (outboard) of a spring set 48, there is no transom mounted between the bottom of the springs and seat 44. Seat 44 has a peripheral lip 52 for discouraging the escape of the bottom ends the of springs.

The spring group, or spring set 48, is captured between the distal end 28 of bolster 22 and spring seat 44, being placed under compression by the weight of the rail car body and lading that bears upon bolster 22 from above.

Friction damping is provided by damping wedges 62 that seat in mating bolster pockets 64 that have inclined damper seats 66. The vertical sliding faces 70 of the friction damper wedges 62 then ride up and down on friction wear plates 72 mounted to the inwardly facing surfaces of sideframe columns 34. Angled faces 74 of wedges 62 ride against the angled face of seat 66. Bolster 22 has inboard and outboard gibbs 76, 78 respectively, that bound the lateral motion of bolster 22 relative to sideframe columns 34. This motion allowance may advantageously be in the range of +/−1⅛ to 1¾ inches, and is most preferably in the range of 1 3/16 to 1 9/16 inches, and can be set, for example, at 1½ inches or 1¼ inches of lateral travel to either side of a neutral, or centered, position when the sideframe is undeflected.

As in the prior art swing motion truck A20, a spring group of 8 springs in a 3:2:3 arrangement is used. Other configurations of spring groups could be used, such as these described below.

Figure 4:
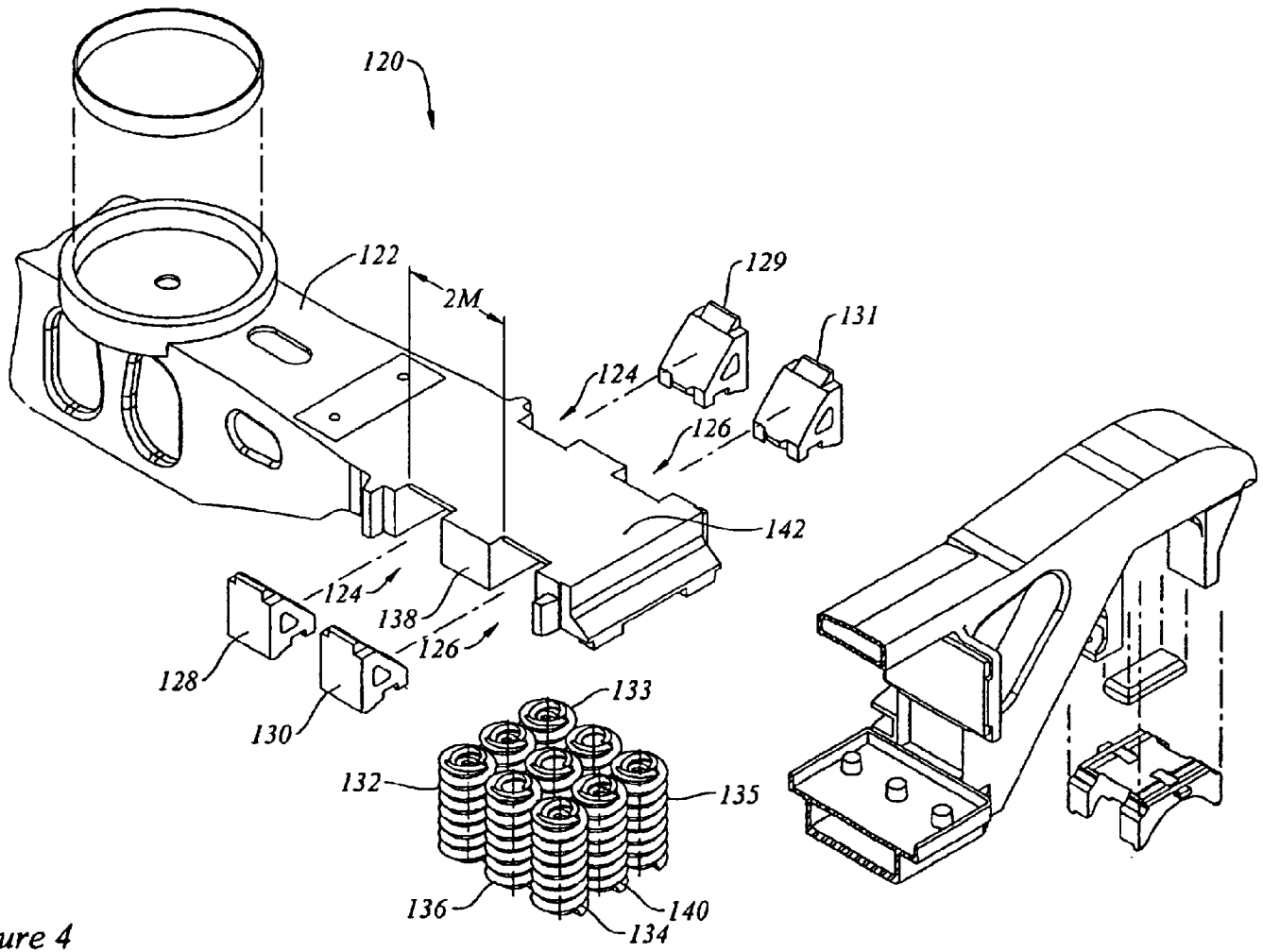

In the embodiment of FIG. 4, a truck 120 is substantially similar to truck 20, but differs insofar as truck 120 has a bolster 122 having double bolster pockets 124 126 on each face of the bolster at the outboard end. Bolster pockets 124, 126 accommodate a pair of first and second, laterally inboard and laterally outboard friction damper wedges 128, 129 and 130, 131, respectively. Wedges 128, 129 each sit over a first, inboard corner spring 132, 133, and wedges 130, 131 each sit over a second, outboard corner spring 134, 135. In this four corner arrangement, each damper is individually sprung by one or another of the springs in the spring group. The static compression of the springs under the weight of the car body and lading tends to act as a spring loading to bias the damper to act along the slope of the bolster pocket to force the friction surface against the sideframe. As such, the dampers co-operate in acting as biased members working between the bolster and the side frames to resist parallelogram, or lozenging, deformation of the side frame relative to the truck bolster. A middle end spring 136 bears on the underside of a land 138 located intermediate bolster pockets 124 and 126. The top ends of the central row of springs, 140, seat under the main central portion 142 of the end of bolster 122.

The lower ends of the springs of the entire spring group, identified generally as 144, seat in the lower spring seat 146. Lower spring seat 146 has the layout of a tray with an upturned rectangular peripheral lip. Lower spring seat 146 is rigidly mounted to the lower chord 148 of sideframe 122. In this case, spring group 144 has a 3 rows×3 columns layout, rather than the 3:2:3 arrangement of truck 20. A 3×5 layout as shown in FIG. 5*e* could be used, as could other alternate spring group layouts. Truck 120 is free of any rigid, unsprung lateral sideframe connection members such as transom A60.

It will be noted that bearing plate 150 mounted to vertical sideframe columns 152 is significantly wider than the corresponding bearing plate 72 of truck 20 of FIG. 2*a*. This additional width corresponds to the additional overall damper span width measured fully across the damper pairs, plus lateral travel as noted above, typically allowing 1½ (+/−) inches of lateral travel of the bolster relative to the sideframe to either side of the undeflected central position. That is, rather than having the width of one coil, plus allowance for travel, plate 152 has the width of three coils, plus allowance to accommodate 1½ (+/−) inches of travel to either side. Plate 152 is significantly wider than the through thickness of the sideframes more generally, as measured, for example, at the pedestals.

Damper wedges 128 and 130 sit over 44% (+/−) of the spring group i.e., 4/9 of a 3 rows×3 columns group as shown in FIG. 4, whereas wedges 70 only sat over 2/8 of the 3:2:3 group in FIG. 3*a*. For the same proportion of vertical damping, wedges 128 and 130 may tend to have a larger included angle (i.e., between the wedge hypotenuse and the vertical face for engaging the friction wear plates on the sideframe columns 34. For example, if the included angle of friction wedges 72 is about 35 degrees, then, assuming a similar overall spring group stiffness, and single coils, the corresponding angle of wedges 128 and 130 could advantageously be in the range of 50–65 degrees, or more preferably about 55 degrees.

In a 3×5 group such as group 276 of truck 270 of FIGS. 7*a* to 7*f*, for coils of equal stiffness, the wedge angle may tend to be in the 35 to 45 degree range, with a preferred value of about 40 degrees. The specific angle will be a function of the specific spring stiffnesses and spring combinations actually employed. Truck 270 has a bolster 272, a side frame 274, a spring group 276, and a damper arrangement 278. The spring group has a 5×3 arrangement, with the dampers being in a spaced arrangement generally as shown in FIG. 4, (i.e., a four cornered damper arrangement, where the opposed bearing surfaces on the sideframe columns are planar and parallel) and having a primary damper angle that may tend to be somewhat sharper given the smaller proportion of the total spring group that works under the dampers (i.e., 4/15 as opposed to 4/9 or 4/8, subject to allowances for differences in coil stiffness).

In one embodiment of truck 270, such as might be used for an end truck of an articulated rail road car, there may be a 5×3 spring group arrangement, the spring group including 11 coils each having a spring rate in the range of 550–650 lb./in, and most preferably about 580 lb./in; and 4 springs (under the dampers, in a four corner arrangement) having a spring rate in the range of 450–550 lb./in, most preferably about 500 lb./in, for which the dampers are driven by 20–25% of the force of the spring group, preferably about 24%. The dampers may have a primary angle of 35–45 deg., preferably about 40 deg. In this preferred end truck embodiment, the overall group vertical spring rate is in the range of 8,000 to 8.500 lb./in., in particular about 8380 lb./in.

In another embodiment of truck 270, such as might be used in an internal truck of an articulated rail road car, there may be a 5×3 spring group arrangement in which the spring group may include 11 outer springs having a spring rate of about 550–650 lb./in., and most preferably about 580 lb./in; 4 springs (under the dampers, in a four corner arrangement) having a spring rate in the range of 550–650 lb./in, and most preferably about 600 lb./in.; and six inner coils having a spring rate in the range of 250–300 lb./in., most preferably about 280 lb./in. The overall spring rate for the 5×3 group is in the range of 10,000–11,000 lb./in., and most preferably about 10,460 lb./in. The dampers are driven by about 20–25% of the total force of the spring group, preferably about 23%. The dampers have a primary angle in the range of 35–35 degrees, preferably about 40 degrees.

It will be appreciated that the values and ranges given for truck 270 depend on the expected empty weight of the railcar, the expected lading, the natural frequency range to be achieved, the amount of damping to be achieved, and so on, and may accordingly vary from the preferred ranges and values indicated above. In another embodiment, the spring group may be very stiff, as for carrying rolls of paper, and may seek to provide a relatively stiff vertical support while also providing a relatively soft lateral response.

The use of spaced apart pairs of dampers 128, 130 may tend to give a larger moment arm, as indicated by dimension "2M", for resisting parallelogram deformation of truck 120 more generally as compared to trucks 20 or A20. Parallelogram deformation may tend to occur, for example, during the "truck hunting" phenomenon that has a tendency to occur in higher speed operation.

Placement of doubled dampers in this way may tend to yield a greater restorative "squaring" force to return the truck to a square orientation than for a single damper alone, as in truck 20. That is, in parallelogram deformation, or lozenging, the differential compression of one diagonal pair of springs (e.g., inboard spring 132 and outboard spring 135 may be more pronouncedly compressed) relative to the other diagonal pair of springs (e g., inboard spring 133 and outboard spring 134 may be less pronouncedly compressed than springs 132 and 135) tends to yield a restorative moment couple acting on the sideframe wear plates. This moment couple tends to rotate the sideframe in a direction to square the truck, (that is, in a position in which the bolster is perpendicular, or "square", to the sideframes) and thus may tend to discourage the lozenging or parallelogramming, noted by Weber.

Another embodiment of multiple damper truck 220 is shown in FIGS. 5*a*, 5*b*, 5*c* and 5*d*. Truck 220 has a wheel set of four wheels 221 and two axles 223. Truck 220 is substantially similar to truck 120, but differs insofar as truck 220 has a bolster 222 having single bolster pockets 225, 226 on opposites sides of the outboard end portion of the bolster, each being of enlarged width, such as double the width of the single pockets shown in FIG. 39, to accommodate a pair of first and second, inboard and outboard friction damper wedges 228, 230, (or 229, 231, opposite side) in side-by-side independently displaceable sliding relationship relative not only to the seat of the pocket, but also with respect to each other, In this instance the spring group, indicated as 232, has a 2 rows×4 columns layout, as seen most clearly in FIG. 5*b*. Wedges 228, 230 each sit over a first corner spring 234, 236 and wedges 229, 231 each sit over a second corner spring 233, 235. The central 2 rows×2 columns of the springs bear on the underside of a land 238 located in the main central portion of the end of bolster 222 longitudinally intermediate bolster pockets 225 and 227.

For the purposes of this description the swivelling, 4 wheel, 2 axle truck 220 has first and second sideframes 224 that can be taken as having the same upper rocker assembly as truck 120, and has a rigidly mounted lower spring seat 240, like spring seat 144, but having a shape to suit the 2 rows×4 columns spring layout rather than the 3×3 layout of truck 120. It may also be noted that sideframe window 242 has greater width between sideframe columns 244, 245 than window 126 between columns 128 to accommodate the longer spring group footprint, and bolster 222 similarly has a wider end to sit over the spring group.

In this example, damper wedges 228, 230 and 229, 232 sit over 50% of the spring group i.e., 4/8 namely springs 234, 236, 233, 235. For the same proportion of vertical damping as in truck 20, wedges 128 and 130 may tend to have a larger included angle, possibly about 60 degrees, although angles in the range of 45 to 70 degrees could be chosen depending on spring combinations and spring stiffnesses. Once again, in a warping condition, the somewhat wider damping region (the width of two full coils plus lateral travel of 1½" (+/−)) of sideframe column wear plates 246, 247 lying between inboard and outboard gibbs 248, 249, 250, 251 relative to truck 20 (a damper width of one coil with travel), sprung on individual springs (inboard and outboard in truck 220, as opposed to a single central coil in truck 20), may tend to generate a moment couple to give a restoring force working on a moment arm. This restoring force may tend to urge the sideframe back to a square orientation relative to the bolster, with diagonally opposite pairs of springs working as described above. In this instance, the springs each work on a moment arm distance corresponding to half of the distance between the centers of the 2 rows of coils, rather than half the 3 coil distance shown in FIG. 4.

One way to encourage an increase in the hunting threshold is to employ a truck having a longer wheelbase, or one whose length is proportionately great relative to its width. For example, at present two axle truck wheelbases may generally range from about 5'-3" to 6'-0". However, the standard North American track gauge is 4'-8½", giving a wheelbase to track width ratio possibly as small as 1.12. At 6'-0" the ratio is roughly 1.27. It would be preferable to employ a wheelbase having a longer aspect ratio relative to the track gauge.

In the case of truck 220, the size of the spring group yields an opening between the vertical columns of sideframe of roughly 33 inches. This is relatively large compared to existing spring groups, being more than 25% greater in width. In an alternate 3×5 spring group arrangement, the opening between the sideframe columns is more than 27½ inches wide. Truck 220 also has a greater wheelbase length, indicated as WB. WB is advantageously greater than 73 inches, or, taken as a ratio to the track gauge width, and is also advantageously greater than 1.30 times the track gauge width. It is preferably greater than 80 inches, or more than 1.4 times the gauge width, and in one embodiment is greater than 1.5 times the track gauge width, being as great, or greater than, about 86 inches.

Figure 5A:
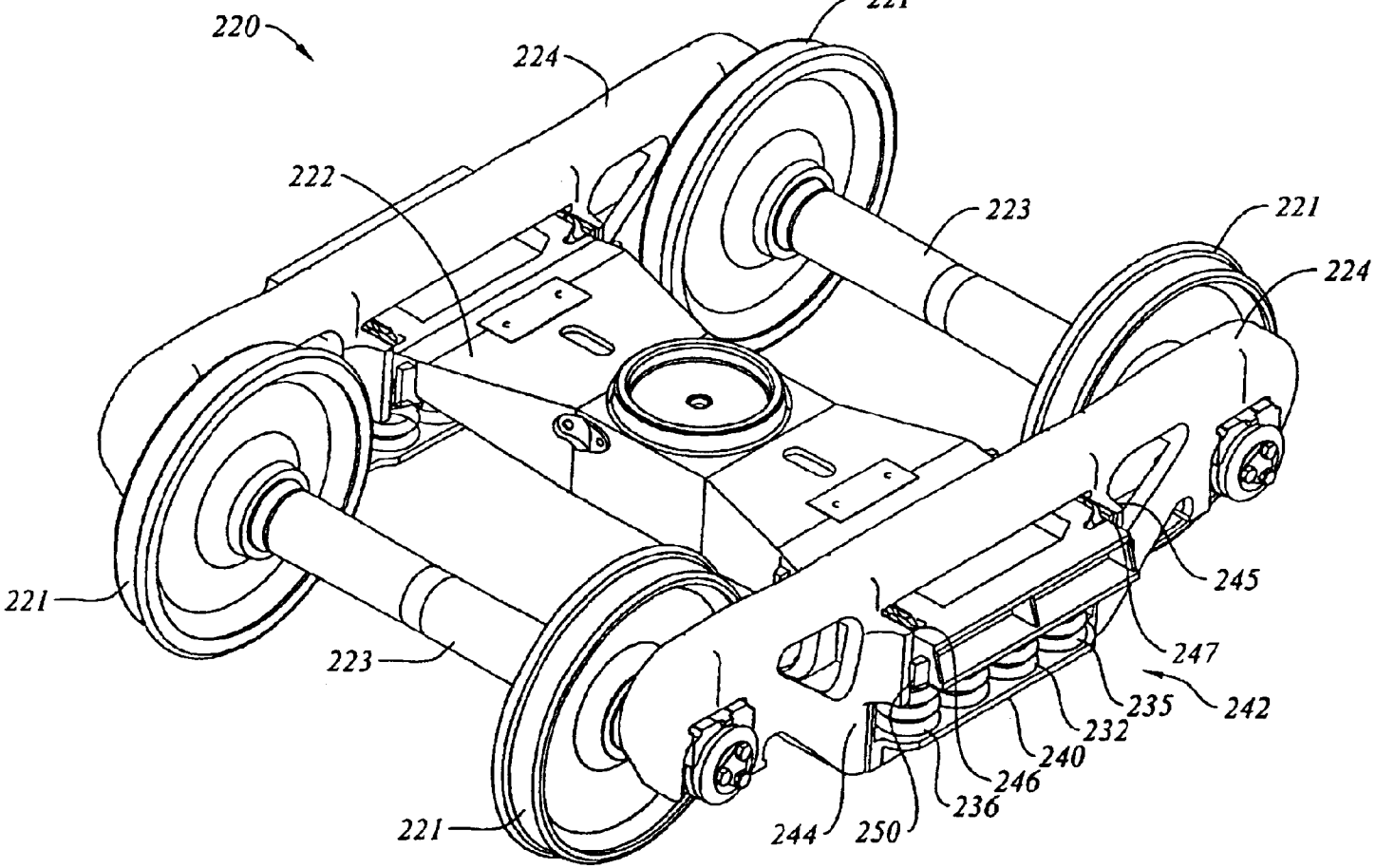
Figure 5B:
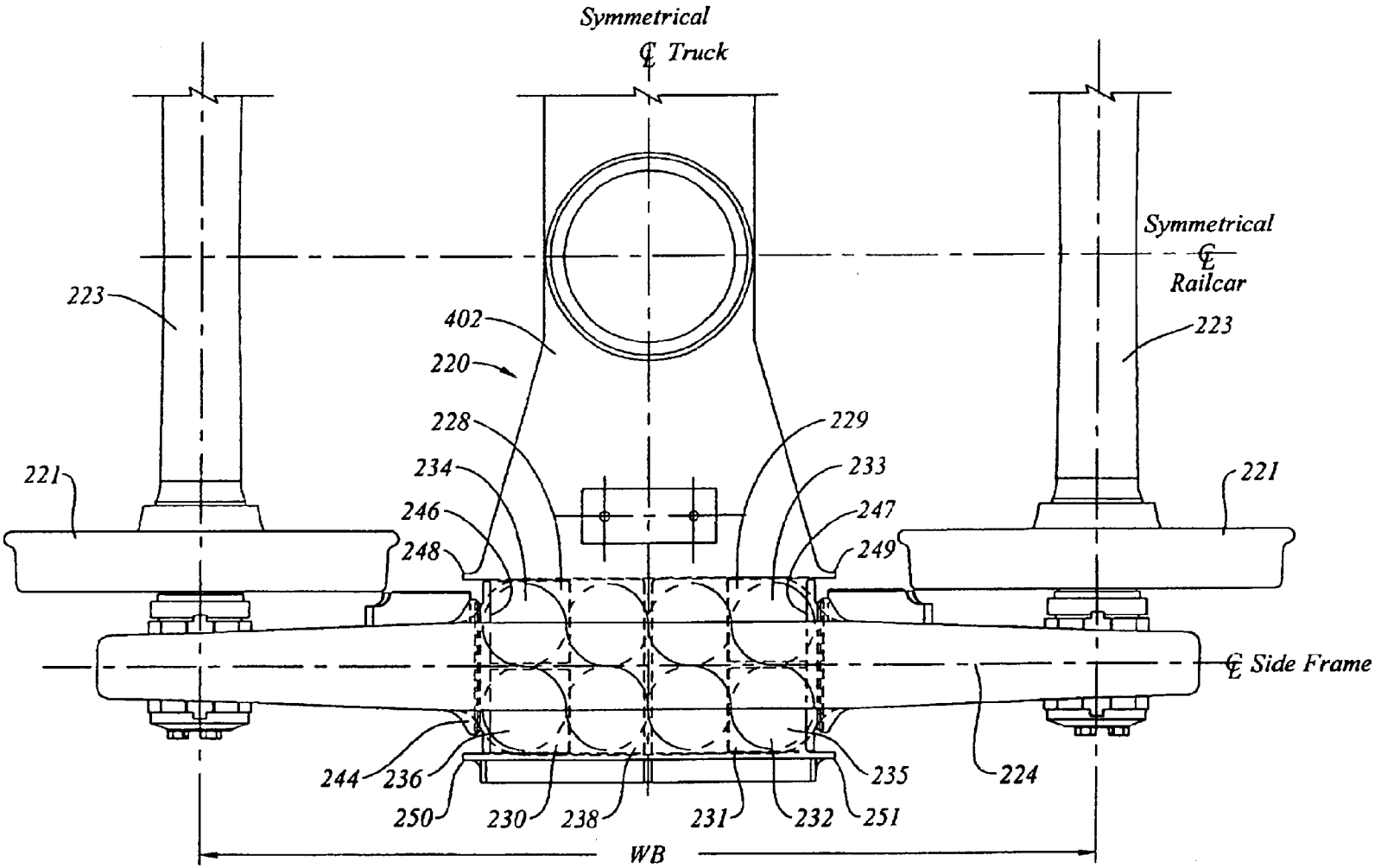
Figure 5C:
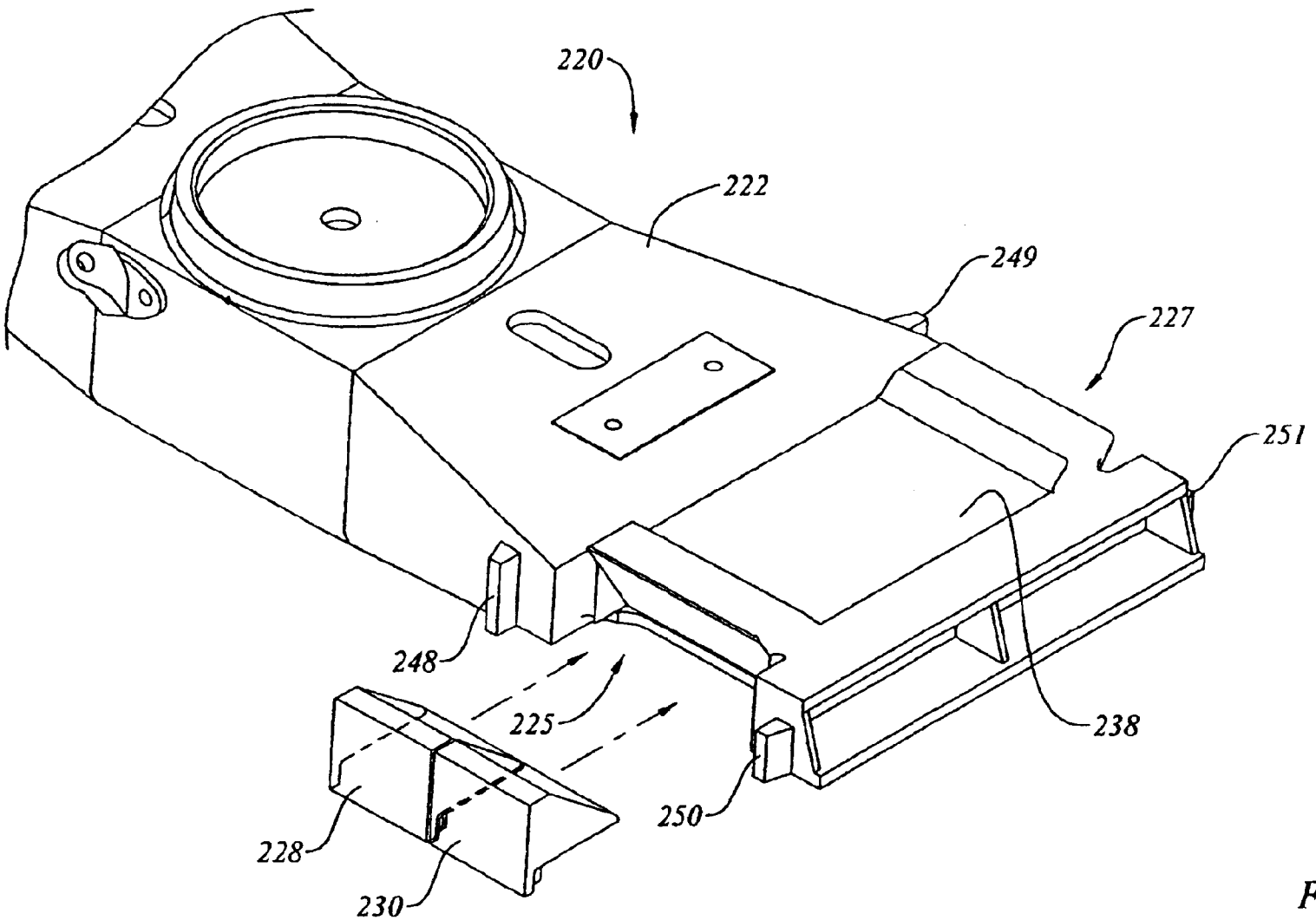
Figure 5D:
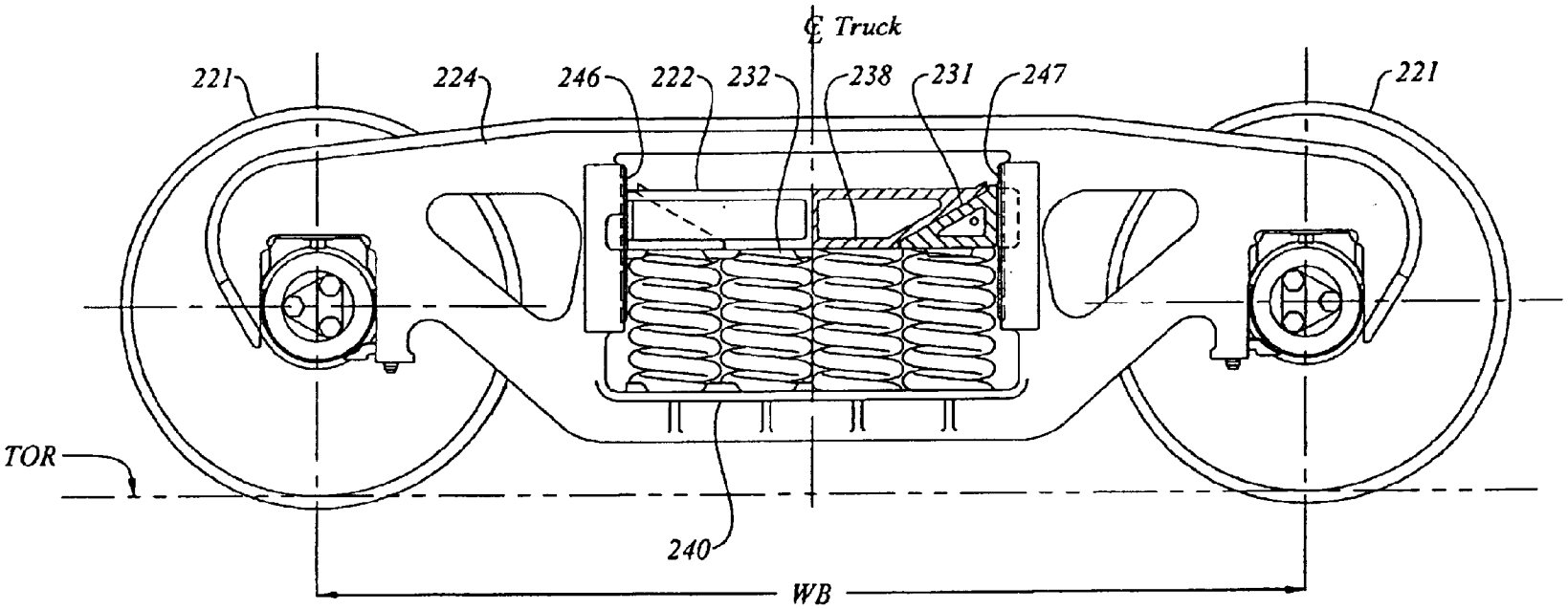

It will be understood that the features of the trucks of FIGS. 2*a*, 2*b*, 3*a*, 3*b*, 4, 5*a*, 5*b*, 5*c*, 5*d* and 7*a* to 7*e* are provided by way of illustration, and that the features of the various trucks can be combined in many different permutations and combinations. That is, a 2×4 spring group could also be used with a single wedge damper per side. Although a single wedge damper per side arrangement is shown in FIGS. 2*a* and 3*a*, a double damper arrangement, as shown in FIGS. 4 and 5*a* is nonetheless preferred as a double damper arrangement may tend to provide enhanced squaring of the truck and resistance to hunting. A 3×3 or 3×5, or other arrangement spring set may be used in place of either a 3:2:3 or 2×4 spring set, with a corresponding adjustment in spring seat plate size and layout. Similarly, the trucks can use a wide sideframe window, and corresponding extra long wheel base, or a smaller window. Further, each of the trucks could employ a rocking bottom spring seat, as in FIG. 2*b*, or a fixed bottom spring seat, as in FIG. 3*a*, 4 or 5*a*.

When a lateral perturbation is passed to the wheels by the rails, the rigid axles will tend to cause both sideframes to deflect in the same direction. The reaction of the sideframes is to swing, rather like pendula, on the upper rockers. The pendulum and the twisted springs will tend to urge the sideframes back to their initial position. The tendency to oscillate harmonically due to the track perturbation will tend to be damped out be the friction of the dampers on the wear plates.

As before, the upper rocker seats are inserts, typically of a hardened material, whose rocking, or engaging surface 80 has a radius of curvature of about five inches, with the center of curvature (when assembled) lying above the upper rockers (i.e., the surface is upwardly concave).

In each of the trucks shown and described herein, for a fully laden car type, the lateral stiffness of the sideframe acting as a pendulum is less than the lateral stiffness of the spring group in shear. In one embodiment, the vertical stiffness of the spring group is less than 12,000 Lbs./in, with a horizontal shear stiffness of less than 6000 Lbs./in. The pendulum has a vertical length measured (when undeflected) from the rolling contact interface at the upper rocker seat to the bottom spring seat of between 12 and 20 inches, preferably between 14 and 18 inches. The equivalent length $L_{eq}$, may be in the range of 8 to 20 inches, depending on truck size and rocker geometry, and is preferably in the range of 11 to 15 inches, and is most preferably between about 7 and 9 inches for 28 inch wheels (70 ton "special"), between about 8½ and 10 inches for 33 inch wheels (70 ton), 9½ and 12 inches for 36 inch wheels (100 or 110 ton), and 11 and 13½ for inches 38inch wheels (125 ton). Although truck 120 or 220 may be a 70 ton special, a 70 ton, 100 ton, 110 ton or 125 ton truck, it is preferred that truck 120 or 220 be a truck size having 33 inch diameter, or even more preferably 36 or 38 inch diameter wheels.

In the trucks described herein according to the present invention, $L_{resultant}$, as defined above, is greater than 10 inches, is advantageously in the range of 15 to 25 inches, and is preferably between 18 and 22 inches, and most preferably close to about 20 inches. In one particular embodiment it is about 19.6 inches, and in another particular embodiment it is about 19.8 inches.

In the trucks described herein, for their fully laden design condition which may be determined either according to the AAR limit for 70, 100, 110 or 125 ton trucks, or, where a lower intended lading is chosen, then in proportion to the vertical sprung load yielding 2 inches of vertical spring deflection in the spring groups, the equivalent lateral stiffness of the sideframe, being the ratio of force to lateral deflection measured at the bottom spring seat, is less than the horizontal shear stiffness of the springs. The equivalent lateral stiffness of the sideframe $k_{sideframe}$ is less than 6000 Lbs./in. and preferably between about 3500 and 5500 Lbs./in., and more preferably in the range of 3700–4100 Lbs./in. By way of an example, in one embodiment a 2×4 spring group has 8 inch diameter springs having a total vertical stiffness of 9600 Lbs./in. per spring group and a corresponding lateral shear stiffness $k_{spring\ shear}$ of 4800 lbs./in. The sideframe has a rigidly mounted lower spring seat. It is used in a truck with 36 inch wheels. In another embodiment, a 3×5 group of 5½ inch diameter springs is used, also having a vertical stiffness of about 9600 lbs./in. In a truck with 36 inch wheels. It is intended that the vertical spring stiffness per spring group be in the range of less than 30,000 lbs./in., that it advantageously be in the range of less than 20,000 lbs./in and that it preferably be in the range of 4,000 to 12000 lbs./in, and most preferably be about 6000 to 10,000 lbs./in. The twisting of the springs has a stiffness in the range of 750 to 1200 lbs./in. and a vertical shear stiffness in the range of 3500 to 5500 lbs./in. with an overall sideframe stiffness in the range of 2000 to 3500 lbs./in.

In the embodiments of trucks in which there is a fixed bottom spring seat, the truck may have a portion of stiffness, attributable to unequal compression of the springs equivalent to 600 to 1200 Lbs./in. of lateral deflection, when the lateral deflection is measured at the bottom of the spring seat on the sideframe. Preferably, this value is less than 1000 Lbs./in., and most preferably is less than 900 Lbs./in. The portion of restoring force attributable to unequal compression of the springs will tend to be greater for a light car as opposed to a fully laden car, i.e., a car laden in such a manner that the truck is approaching its nominal load limit, as set out in the 1997 *Car and Locomotive Cyclopedia* at page 711.

The double damper arrangements shown above can also be varied to include any of the four types of damper installation indicated at page 715 in the 1997 *Car and Locomotive Cyclopedia*, whose information is incorporated herein by reference, with appropriate structural changes for doubled dampers, with each damper being sprung on an individual spring. That is, while inclined surface bolster pockets and inclined wedges seated on the main springs have been shown and described, the friction blocks could be in a horizontal, spring biased installation in a pocket in the bolster itself, and seated on independent springs rather than the main springs. Alternatively, it is possible to mount friction wedges in the sideframes, in either an upward orientation or a downward orientation.

Reduced Radius of Curvature Bearing Adapter

Trucks A20, 10, 120, and 220 discussed thus far have been considered in the context of trucks having the upper rocker, pedestal seat, and bearing adapter rocker geometry of a swing motion truck. However, a conventional, non-swing motion truck does not have the upper rocker arrangement of a swing motion truck as indicated by upper rocker 40 and bearing adapter 42. Rather, it may tend to have a planar pedestal seat bearing surface which makes rolling line contact with a downwardly concave (i.e., crowned) bearing surface of a bearing adapter. The crowned surface may have a radius of curvature of some 60 inches, the center of curvature lying below the surface. As noted above, in a conventional three piece truck suspension the lateral spring stiffness tends to be strongly related to the vertical spring stiffness. A swing motion truck alters this relationship by introducing a relatively soft pendulum. The softness of the pendulum then becomes the dominant element of the lateral response, and is not directly related to the vertical stiffness of the springs.

An aspect of the present invention is to use a bearing adapter having crown having a smaller radius of curvature, such that the pendulum stiffness of the sideframe is preferably less than the shear stiffness of the spring group. That is, the pendulum stiffness is sufficiently low that the shear stiffness in the spring group is no longer so dominant in determining the lateral response of the truck.

Consider, trucks 120 and 220. This trucks have fixed bottom spring seats. In an alternative embodiment, trucks 120 and 220 may not have items 40 and 42. In an alternative embodiment, these trucks may have the basics structure of a truck such as a Barber S2 HD truck, or other commercially available 3 piece truck for interchange service in North America, as opposed to a swing motion truck. In such a truck there may be a conventional spring group arrangement, such as any of the arrangements shown at pages 739–746 of the 1997 *Cyclopedia*, those pages being incorporated herein by reference. The applicant also incorporates by reference pages 811–822 of the 1997 *Cyclopedia* which pertain to bearings. In general, the existing spring group arrangement may typically be a 3×3 arrangement, a 2:3:2 arrangement, or a 3:2:3 arrangement. Such a truck would have a wheel base of 5'-3" to 6'-0", and might typically have an existing set of bearing adapters mounted to the bearings located on the ends of the two axles. An existing type of bearing adapter is shown at page 819 of the 1997 *Cyclopedia*. As is shown more clearly in the photograph at page 834 of the 1997 *Cyclopedia*, the bearing adapter has a bearing surface, or interface that is split into two portions separated by a central channel groove, or slot. The bearing interface has a slight crown. A very detailed illustration, of a bearing adapter is shown at page 682 of the 1980 *Cyclopedia*, in which the crown is indicated as having a 60 inch crown radius, with a tolerance that appears to be +0", −20" in the half side view. The crown radius is concave downward—i.e., the center of curvature lies below the surface.

The pedestal of the sideframe of the existing truck has a mating bearing face, in the nature of a machined flat surface for mating in line contact with the crowned portions of the bearing surface interface in rolling contact. A lateral force transmitted into the bottom spring seat may then tend to cause rolling motion between the crowned interface and flat surface.

The lateral motion of the existing sideframe is constrained by inboard and outboard gibs that may allow roughly about ¼", ⅜" or ½" of lateral travel either inboard or outboard of a central position. (that is, the total lateral travel may be in the range of twice those amounts, namely ½" to 1"). The bottom spring seat of this truck does not have a rocker, but is rigidly located on the lower sideframe member (i.e., the tension member).

Figure 6A:
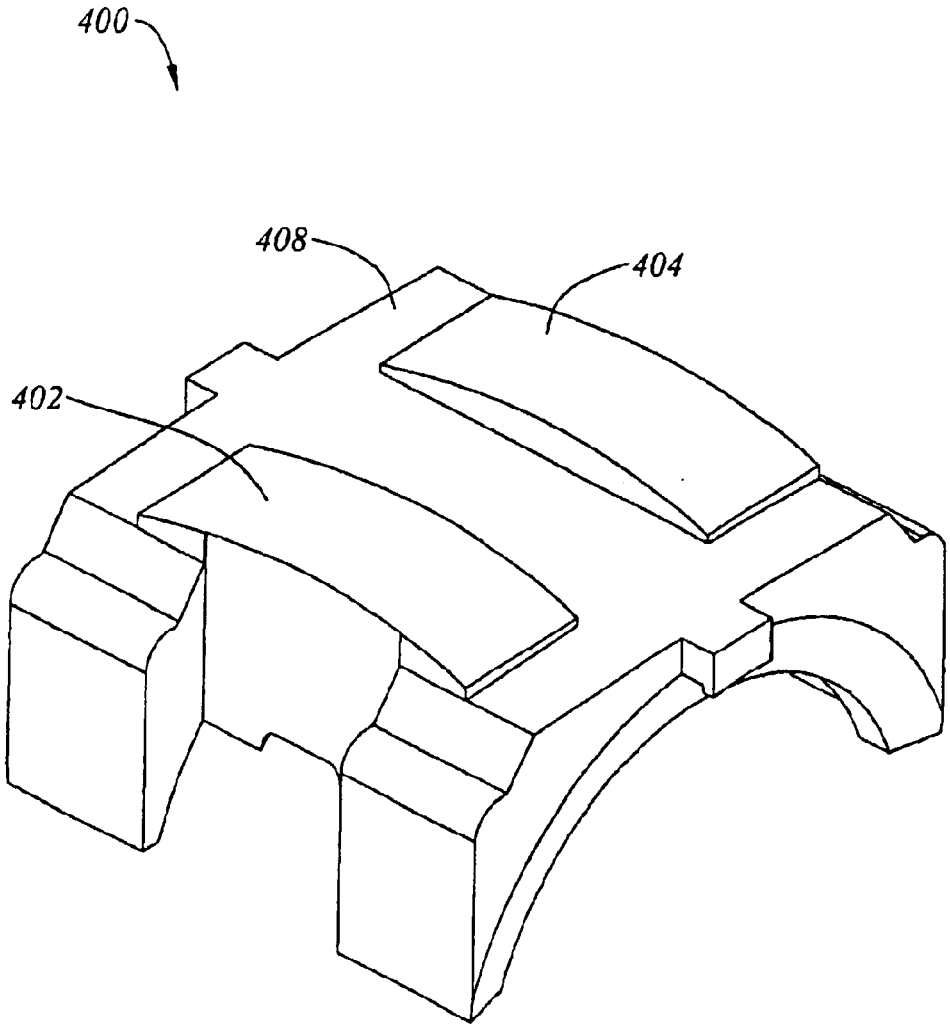
Figure 6D:
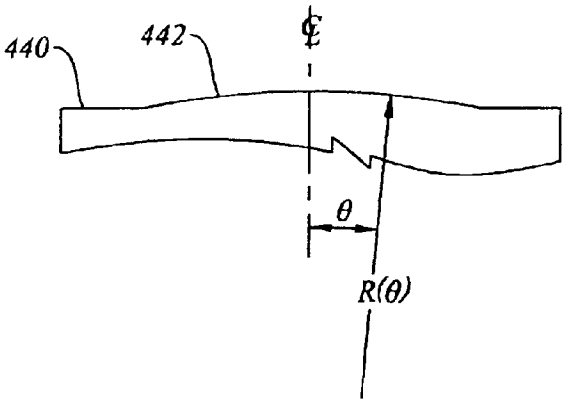
Figure 6E:
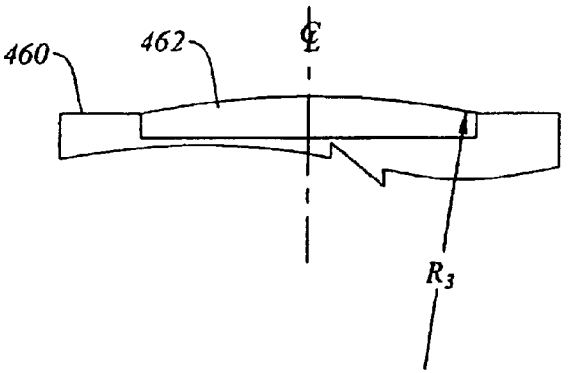
Figure 6B:
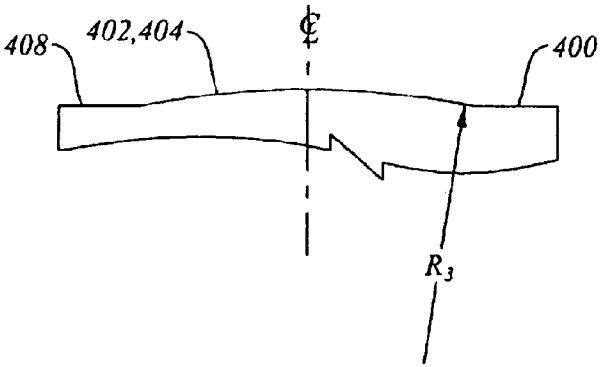

Referring to FIGS. 6*a* to 6*f*, a truck employing bearing adapter 400 may either be constructed originally, or can be retrofit to a converted condition by a number of steps. One step is to remove the existing bearing adapter and replacing it with new bearing adapter 400 as shown in FIGS. 6*a* and 6*b*. New bearing adapter 400 can be taken as being the same as the old bearing adapter except insofar as the profile of the crowned interface of new bearing adapter 400 has a significantly reduced radius of curvature R3. That is, if made on a circular arc, the radius of curvature of arcuate portions 402 and 404 of bearing adapter 400 may be in the range of less than 30". The radius of curvature may be in the range of 3 to 24 inches, in a narrower range of 3 to 12 inches, advantageously in the range of 4 to 8 inches, and preferably about 5". The curved crown portion of bearing adapter 400 merges into the surrounding generally planar portions 408 of the upper surface of bearing adapter 400 more generally.

Figure 6C:
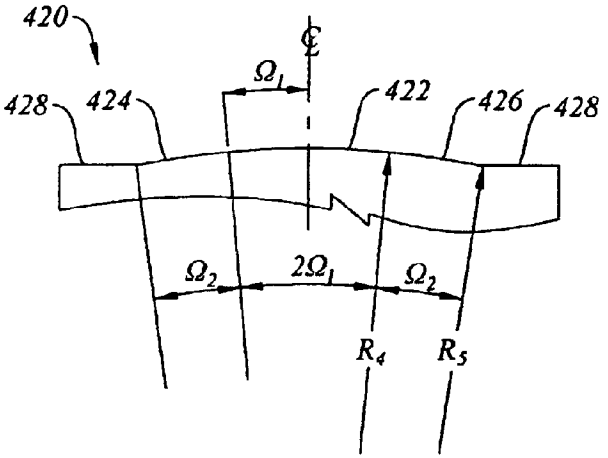

A further alternate embodiment of bearing adapter profile is shown in FIG. 6*c*. In this instance bearing adapter 420 has a central portion 422 having a radius of curvature R4, which, like R3, is significantly less than 60". Adjacent to central portion 422, bearing adapter 420 has shoulder portions 424 and 426 having greater radii of curvature R5 than central portion 422, the edges of shoulder portions 424 and 426 merging with the surrounding surface 428. The line of intersection of the shoulder regions lies at an angle Ω1 (omega) from the vertical. In the region between + and −Ω1 to either side of the central position, namely in the Ω2 region, the pendulum behavior of the sideframe may tend to be governed by the first radius of curvature. Outside of that central range, it will tend to be governed by the radius of curvature of shoulder portions 424 and 426. This may tend yield a two regime dynamic response to lateral input perturbations, namely a relatively soft, low amplitude portion central portion, and a stiffer, larger amplitude portion corresponding to the shoulders. In one embodiment the first region may tend to have a radius of curvature in the range of 3 to 10 inches, or more preferably about 4–6 inches, and most preferably about 5 inches, while the second region may have a radius of curvature in the range of 10 to 30 inches, or more preferably 12 to 20 inches, and most preferably about 15 inches. The size of the angle Ω1 may be such as to give a lateral deflection under the first regime of ¾" to 1¼" an inch, and preferably about 1" to either side of a central position, when deflection is measured at the bottom spring scat. Alternatively, as measured by angle, the size of angle omega may be about 2½ to about 4 degrees, and preferably about 3¼ degrees.

In a further alternate embodiment of the invention, in FIG. 6*e*, a bearing adapter 440 may have a crown profile 442 for which one or more portions have a continuously changing radius of curvature R(θ) (meaning R is a function of theta, the given angle from the vertical), from a minimum at the central rest position (i.e., at zero degrees lateral deflection)

to a maximum at the point at which the side frame abuts one or other of the inboard or outboard gibs. For example, profile 442 may be in the form of a downwardly opening curve, for which the instantaneous radius of curvature is smallest, perhaps in the range of 3–6 inches, at the central region, and larger to either side thereof, ranging up to perhaps 15–20 inches at the edge of the zone of travel when the sideframe abuts one or other of the gibs.

The sideframe may tend to bottom out on the bolster gibs before the rolling line of contact runs off the arcuate surfaces. When this occurs, the truck bolster is constrained from further lateral motion relative to the side frames, and may then tend to deflect in a rocking motion on the main springs, depending on the mass carried, and on the height of the center of gravity of that mass, and the magnitude of the lateral input perturbation at track level, yielding a third possible, rocking, regime outside the first and second regimes corresponding to the radii of the first and second regions of the arcuate crown profile.

It may be that a particular material is preferred for fabrication of these arcuate surfaces. To that end, the arcuate bearing surface of the bearing adapter may be strengthened, or hardened, and a suitably strengthened or hardened seat may be installed in the sideframe pedestal. Alternatively, as shown in FIG. 6*e*, any of the various embodiments of curved bearing surface of FIG. 6*a*, 6*c*, or 6*d* may employ an insert 462, as shown in bearing adapter 460, the insert being made of a similar material to that used for rockers and rocker seats in a swing motion truck.

Figure 6F:
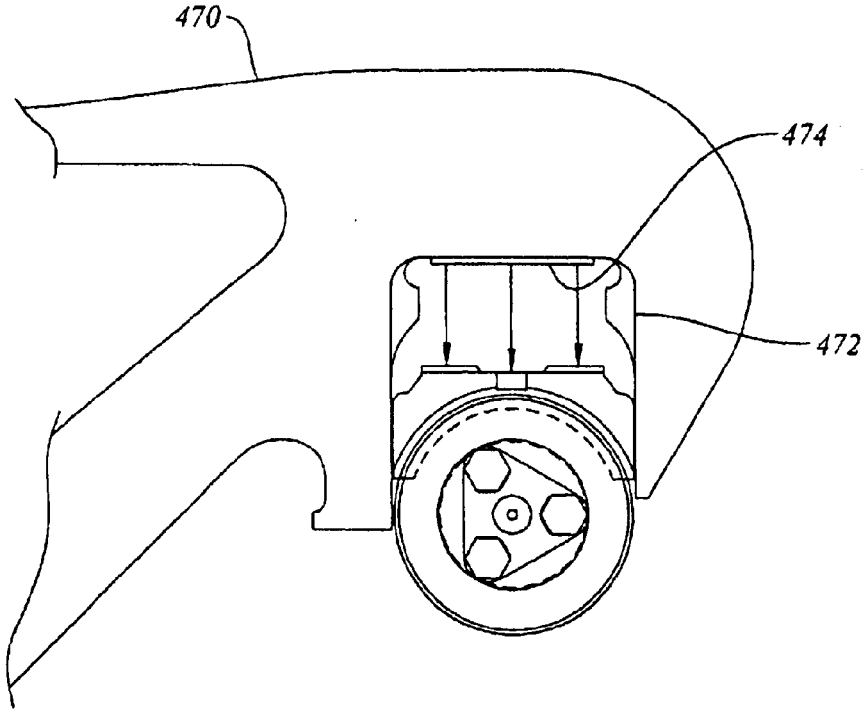
Figure 6F:
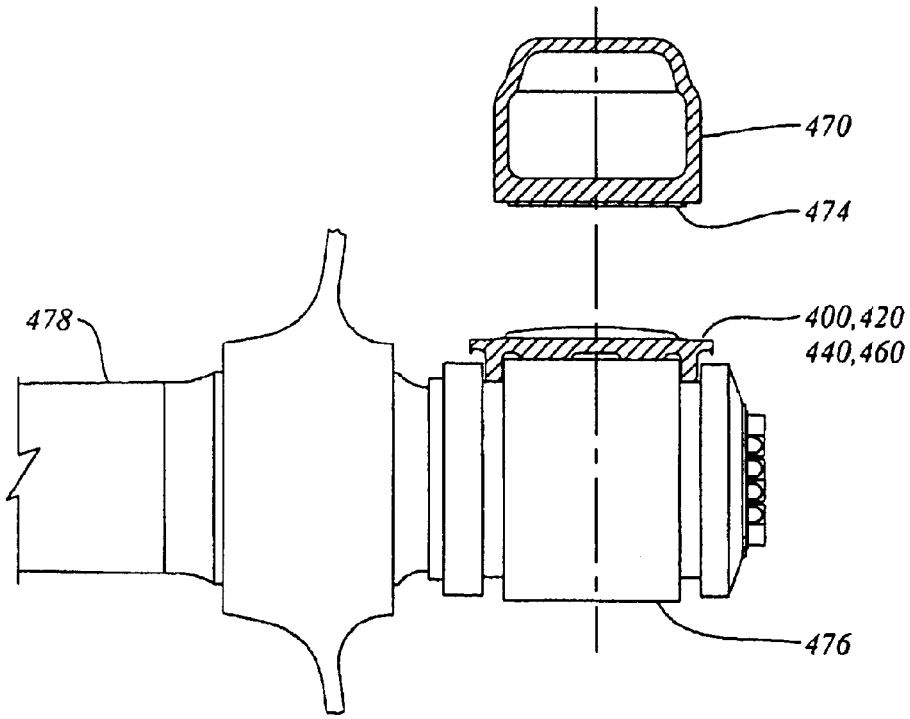
Figure 7A:
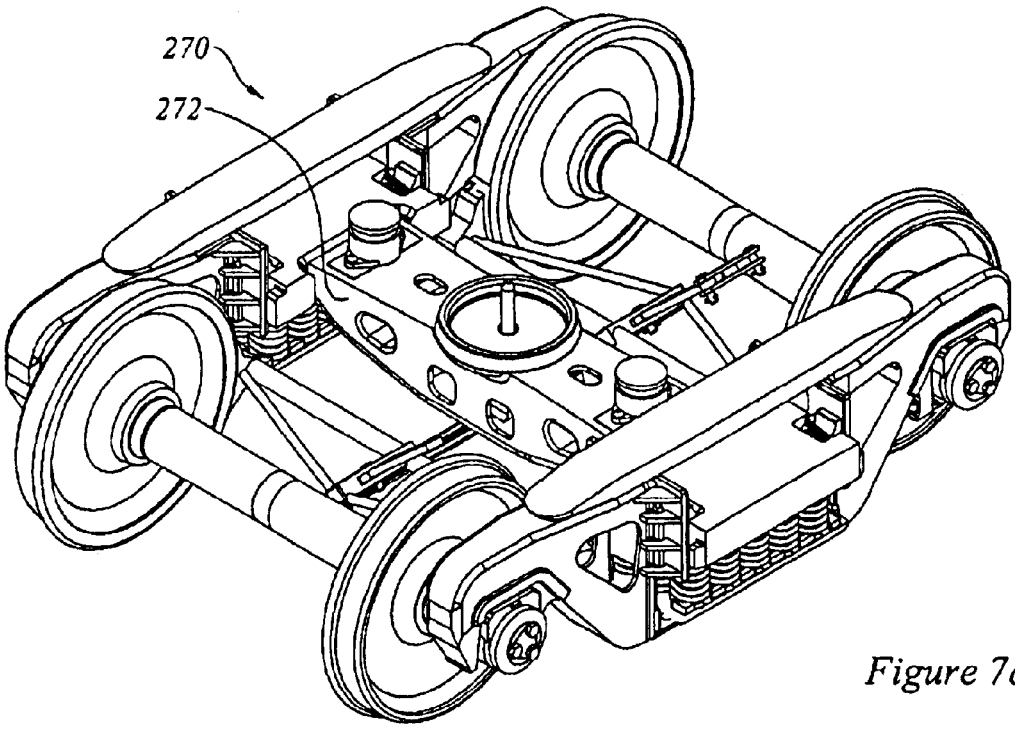
Figure 7D:
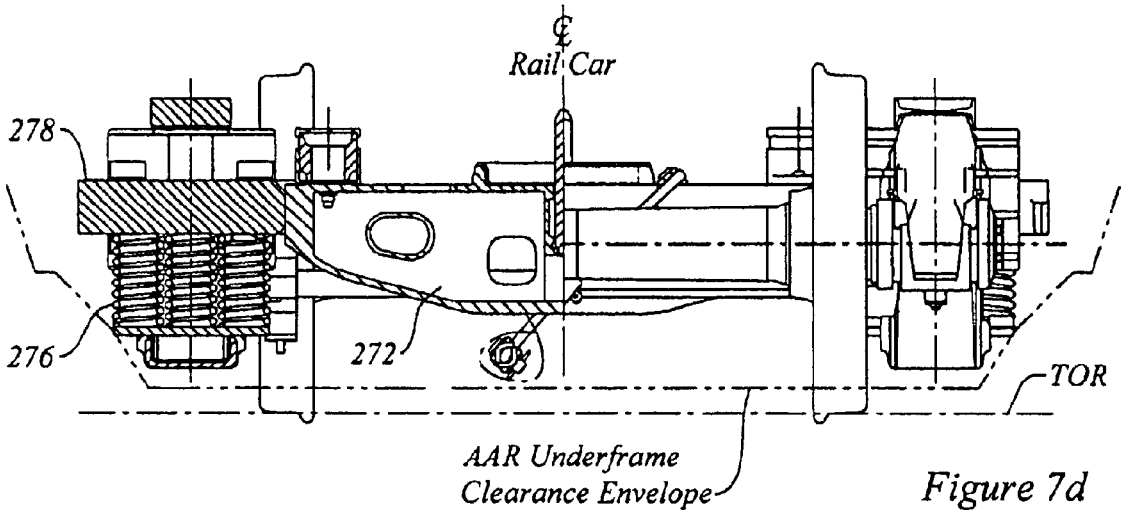
Figure 7E:
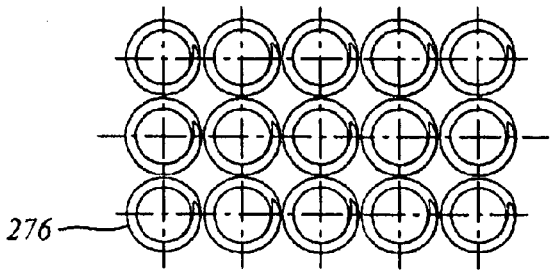
Figure 7B:
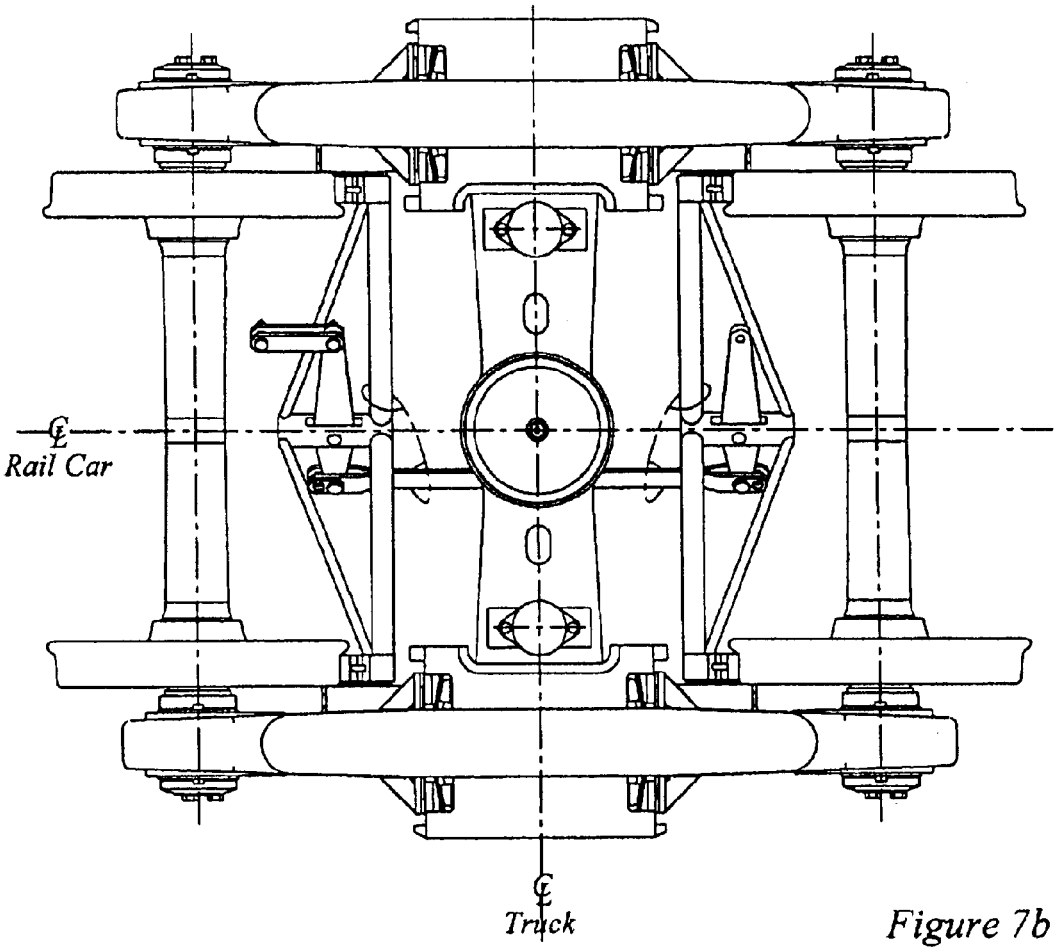
Figure 7C:
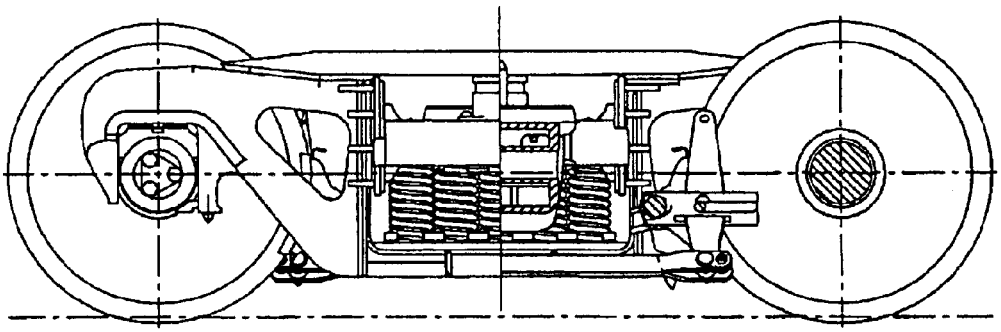
Figure 7F:
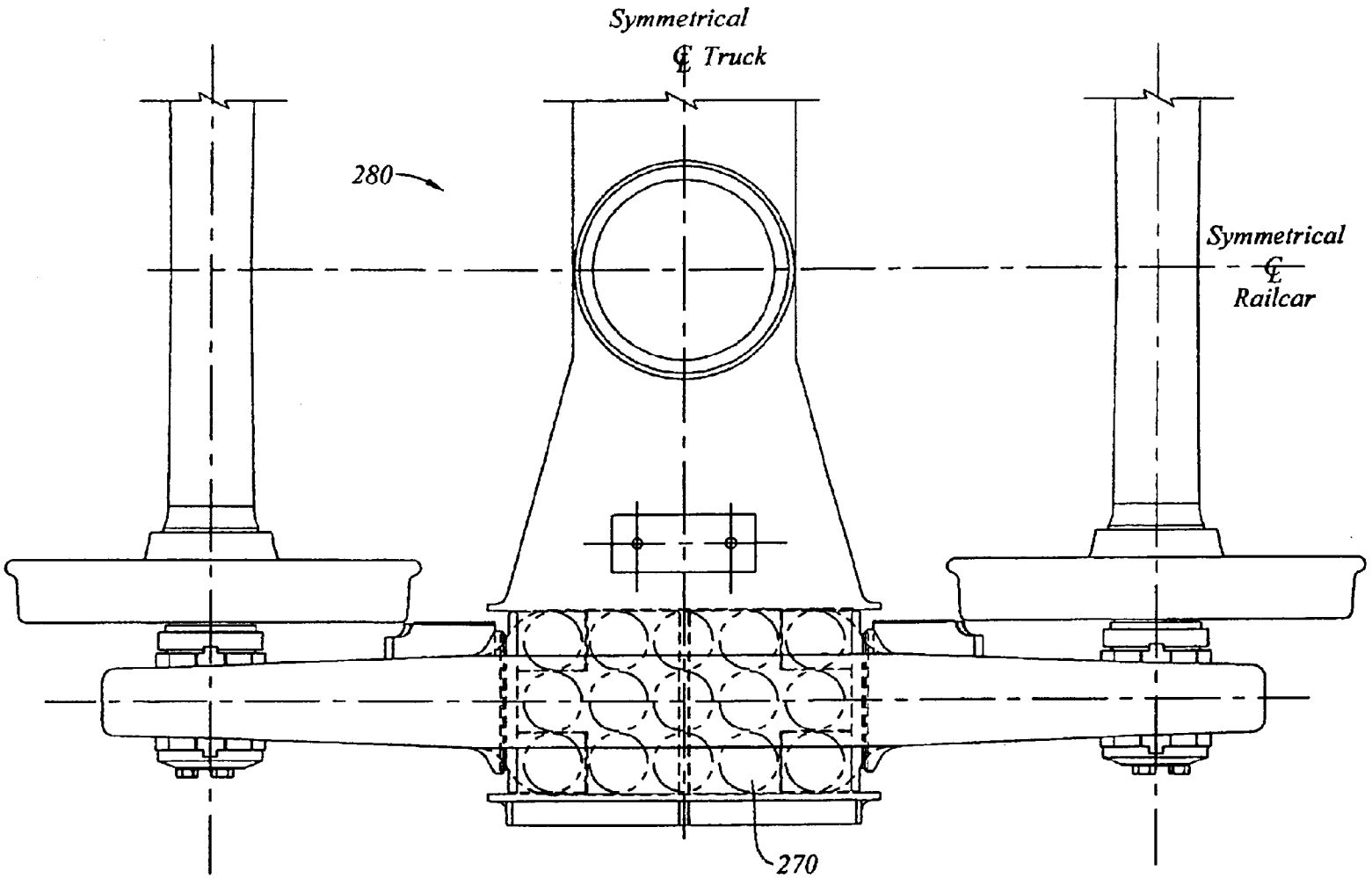

FIG. 6*f*, based on the illustration at page 819 of the 1997 *Cyclopedia*, shows the general installation position of the bearing adapter, be it 400, 420, 440, or 460, in the side frame, indicated generically as 470, the pedestal mounting 472 having a flat bearing surface 474. The bearing is indicated as 476. The axle is on which the bearing is mounted is indicated as 478.

Retro-Fit Gibs

To accommodate greater lateral movement, the truck, whether new or retro-fit, may be provided with a gib arrangement allowing greater lateral travel as in truck 120, Or 220. That is, for a retro-fit truck, the existing gibs may be removed, and replacement gibs provided and installed on a wider spacing, corresponding to that shown for trucks 120 and 220 above, While the desired range of gib spacing may be at least 1" inch to either side of an at rest centered position of the sideframe between the gibs, it is preferred if the gib spacing dimension be in the range of 1¼" to 1¾", preferably in the range of 1⅜" to 1⅝", and most preferably about 1½" to either side of the at rest central position. While it is preferable that the gib spacing be symmetrical relative to the central, at rest, position of the truck bolster relative to the sideframes, it is not necessarily so. That is, the outboard gib spacing may be slightly greater than the inboard gib spacing, perhaps by as much as ⅜".

Retro-Fit Damper Arrangement

The retro-fit truck may be provided with a 4 corner damper arrangement, as in truck 120, 220. To that end, an existing bolster may be removed and replaced with a bolster originally manufactured with a four-corner damper arrangement as in truck 120, or 220, or, alternatively, the outboard end portions of the existing bolster may be rebuilt with inserts, each insert having a pair of spaced apart damper pockets, and damper wedges to seat above the corner springs of the spring group arrangement. As will be understood, where the same proportion of vertical damping force is desired as before, the angle of the damper wedges may be adjusted correspondingly to larger angles, there being a variety of possible damper arrangements, whether split dampers, or dampers having both primary and secondary angles, or combinations thereof Alternatively, the springs in the spring group can be subject to a different selection of sizes and a different damper wedge angle to give the desired amount of damping.

Where a four-cornered damper arrangement is to be installed by retro-fit, existing side frame column wear plates may be removed, and replaced by corresponding new, wider, side frame column wear plates of appropriate width to accommodate both the wider damper arrangement, and the lateral travel of the bolster relative to the side frames.

A truck modified in this manner (or built as original equipment in this manner) may tend to be able to retain substantially the same, relatively stiff, vertical spring stiffness as it had before being modified, yet may have a significantly softened lateral response for which the dominant element of lateral stiffness is the softness of the pendulum. For a set of springs in a spring group having an overall vertical spring rate of about 25,000 lbs/inch (+/−5,000 lbs/inch), and a radius of curvature on the pendulum surface of 5 inches, the effective lateral stiffness for a laden 286,000 lbs., box car, such as may be used for carrying rolls of paper may be have a pendulum stiffness in the range of about 4,000–6000 lbs/in of lateral deflection measured at the end of the bolster, and preferably in the range of about 5000 lbs/in or somewhat less than that. Depending on the actual value, this value may be roughly half of the value that might otherwise have been the case before modification of the truck.

Optionally, where the truck originally has a frame brace, that frame brace may be removed. If the truck originally had a transom, that transom may be removed.

Figure 8:
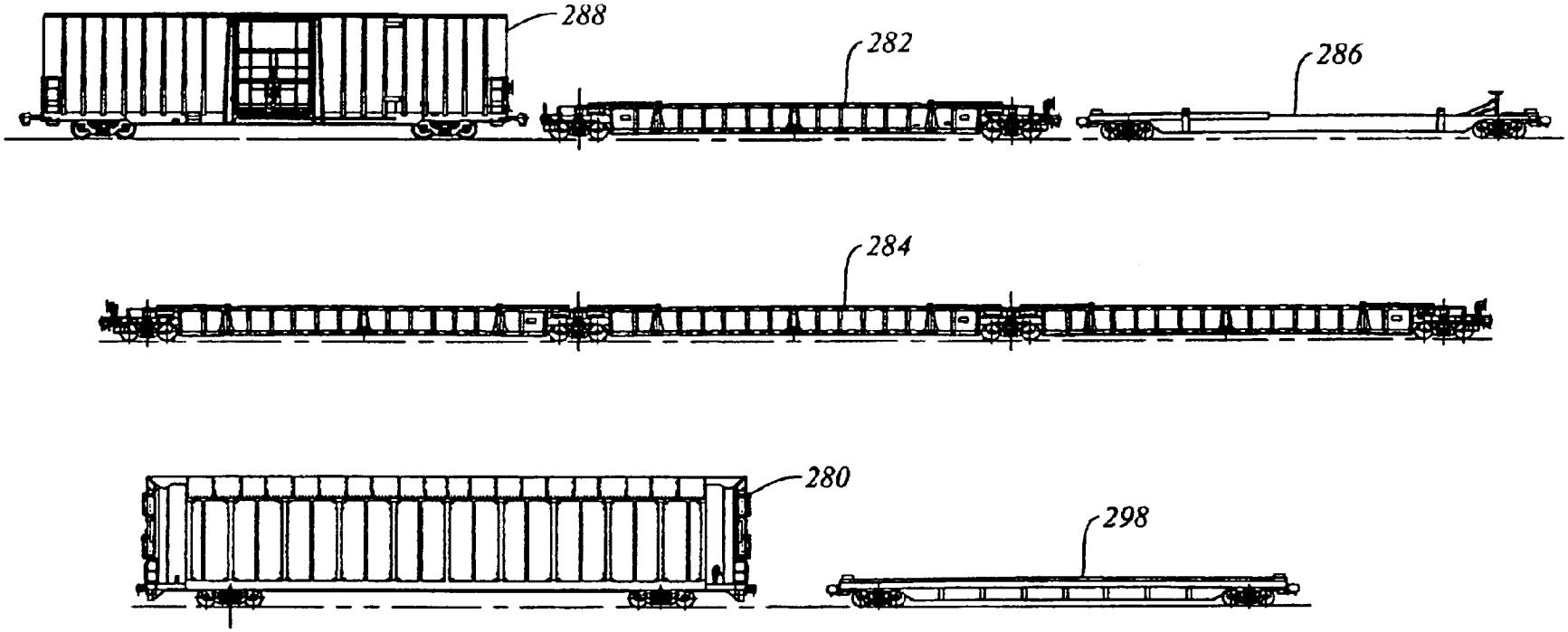
FIG. 8 shows car types having trucks as described herein.

The trucks of the foregoing embodiments may be used with relatively soft vertical spring rate spring groups, where the vertical spring rate of the group is less than about 18,000 to 20,000 lbs, per inch, and possibly less than 12,000 lbs per inch, such as might tend to be suitable to give a softer ride for low density, high value goods such as automobiles, white goods, electronic equipment or other consumer goods more generally, Such a truck may be employed in the types of freight car shown in FIG. 8, namely an autorack rail road car 280 (whether in single units or articulated); an intermodal well car 282 (whether in single units, as 282, or articulated as 284), such as, for example, a double stack container carrying well car; a spine car for carrying highway trailers 286 (whether as a single unit or articulated); an auto-parts box car or a box car for consumer merchandise 288; an intermodal flat car 290; or, more generally for any kind of rail road car with a relatively low density, fragile type of lading.

Figure 9:
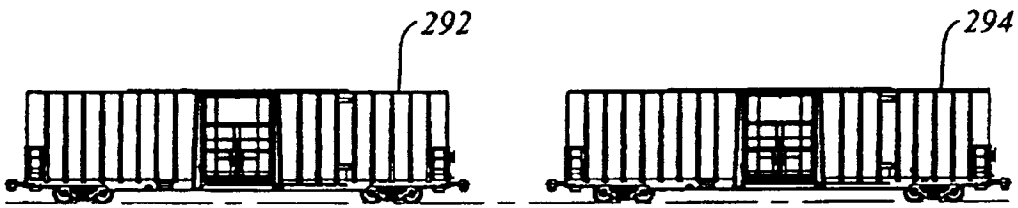
FIG. 9 shows a different group of car types having trucks as described herein.

Alternatively, the trucks of the foregoing embodiments may be used with stiffer vertical spring rates, in the ranges above 20,000 lbs/in per spring group, and more strongly, in the range of greater than 25,000 lbs/in per spring group, such as might be used in freight cars 292 such as shown in FIG. 9 for carrying general merchandise or commodities of greater density, including rail road freight car 294 for carrying rolls of paper, for which a relatively soft lateral response might still be desired.

In one embodiment, a truck, in particular a 110 Ton variation of truck 120 or 220, may have a 3×3 or 3.2:3, or 2:3:2 spring group of relatively high vertical stiffness (e.g., more than 20,000 lbs/inch per spring group), a four cornered damper arrangement, a bearing adapter and side frame pedestal arrangement having a rolling contact on a relatively small radius of curvature (4–6 inches), with gibs accordingly spaced to permit relatively generous lateral travel (e.g., the in the range of 1 to 1⅝ inches to either side of a central rest position) of the truck bolster with respect to the sideframes. Such a truck may be intended for service in a paper carrying box car or an auto-parts box car. Parameter values for 5 different embodiments 110 Ton trucks having 3×3 spring group arrangements with fixed side frame bottom seats and four cornered damper layouts are attached as appendix A hereto. The parameter values in these embodiments are approximate, and may include values +/−10% lesser or greater than the values indicated.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

Various embodiments of the invention have now been described in detail. Since changes in and or additions to the above-described best mode may be made without departing from the nature, spirit or scope of the invention, the invention is not to be limited to those details but only by the appended claims.

I claim:

1. A rail road car truck comprising:

a pair of first and second side frames and a truck bolster resiliently mounted transversely relative thereto;

wheelsets, each wheelset having an axle having two wheels mounted thereto, and each axle being mounted to said side frames;

each of said side frames having pedestal seats for receiving mating bearing adapters;

a bearing adapter mounted to each end of each axle, each bearing adapter being matingly engaged in one of said pedestal seats;

said pedestal seats having a bearing surface for mating with said bearing adapter;

said mating bearing surface being chosen from the set of bearing surfaces consisting of (a) a planar surface; and (b) an arcuate surface having a radius of curvature greater than 50 inches;

said bearing adapter having a crown upon which said bearing surface of said pedestal seat is engaged to permit lateral rocking motion of said sideframe;

said crown having a local radius of curvature of less than 30 inches.

2. The rail road car truck of claim 1 wherein said radius of curvature is constant over an arc extending at least 2 degrees to either side of a central resting position.

3. The rail road car truck of claim 1 wherein said truck bolster has lateral travel relative to said side frames of at least 1 inch to either side of a central resting position.

4. The rail road car truck of claim 3 wherein said lateral travel of said truck bolster relative to said side frames is limited by abutment means mounted thereto.

5. The rail road car truck of claim 4 wherein said abutment means includes at least one gib mounted to one of (a) said truck bolster and (b) said side frames, and a mating abutment mounted to the other of(a) said side frames, and (b) said truck bolster.

6. The bearing adapter of claim 1 wherein said radius of curvature is less than 10 inches.

7. A bearing adapter for use in a three-piece rail road car truck, the bearing adapter being mountable to a bearing of an end of an axle of a rail road car wheelset, wherein the bearing adapter has a crown for engaging a pedestal seat of a side frame of the rail road car truck, said crown permitting transverse rocking of the side frame mounted thereon, said crown having a first region rockingly engageable with a contact surface of the pedestal seat, said first region including a crest having a local radius of curvature of less than 30inches, and said crown having a second region adjoining said first region, said second region being configured to rockingly engage said contact surface of the pedestal seat, and said second region of said crown has a different radius of curvature than said crest.

8. The bearing adapter of claim 7 wherein said second region has a local radius of curvature greater than said crest region.

9. The bearing adapter of claim 7 wherein said radius of curvature of said crown varies from a first radius of curvature at said crest to a greater radius of curvature away from said crest.

10. The bearing adapter of claim 7 wherein said radius of curvature is constant over a range of motion of at least 2 degrees of arc to either side of a central position.

11. The combination of a bearing adapter for a rail road freight car truck, and a mating pedestal seat for a sideframe of a rail road freight car truck, said bearing adapter having a crown, said pedestal seat having a mating bearing surface for rocking engagement with said crown to permit lateral rocking of the sideframe, said crown having a radius of curvature, said mating bearing surface being chosen from the set of bearing surfaces consisting of (a) a planar surface; and (b) an arcuate surface having a radius of curvature greater than 50 inches; and said radius of curvature of said crown being less than 30 inches.

12. The combination of claim 11 wherein said radius of curvature of said crown is constant over an arc extending at least 2 degrees to either side of a central resting position.

13. The combination of claim 11 wherein said radius of curvature of said crown is less than 10 inches.

14. The combination of claim 11 wherein said crown has a first region at said crest, and a second region adjacent thereto, said second region having a local radius of curvature greater than said crest region.

15. The combination of claim 14 wherein said radius of curvature of said crown varies from a first radius of curvature at said crest to a greater radius of curvature away from said crest.

16. A process of retro-fitting a two axle, four wheel, three piece rail road car truck having a pair of side frames, a truck bolster resiliently mounted transversely to said side frames, said axles having bearings mounted thereto and (first bearing adapters mounted to said bearings, said side frames having bearing pedestal mounts, said bearing adapters being rockingly engaged with said bearing pedestal mounts to permit lateral swinging of said side frames, each said bearing adapter having a crowned surface rockingly engaged to a mating bearing surface of said bearing pedestal mount, said crowned surface having a radius of curvature of greater than 50 inches, said process comprising the steps of (a) extracting said bearing adapters from said truck; (b) replacing said first bearing adapters with second bearing adapters having a crowned surface having a smaller radius of curvature than before, and (c) installing an arrangement of dampers between the bolster and each sideframe, each said arrangement of dampers including four dampers and having four corners, and said second bearing adapters having a radius of curvature of less than 30 inches.

17. A three piece rail road car truck, said truck comprising a pair of spaced apart sideframes and a truck bolster extending therebetween, said truck bolster having ends resiliently supported by said side frames, said side frames being mounted on wheel sets, each said wheelset having an axle and two wheels mounted thereto, each said wheelset having bearings and bearing adapters mounted thereto, said bearing adapters having crowns, said sideframes having pedestal seats for mating engagement with said crowns of said curvature of less than 30 inches, each of said ends of said truck bolster having an arrangement of dampers, each said arrangement of dampers including four dampers and having four corners, and each said arrangement of dampers being mounted to act between one of said ends of said bolster and one of said sideframes.

* * * * *

UNITED STATES PATENT AND TRADEMARK OFFICE

CERTIFICATE OF CORRECTION

PATENT NO. : 6,874,426 B2
DATED : April 5, 2005
INVENTOR(S) : James W. Forbes

It is certified that error appears in the above-identified patent and that said Letters Patent is hereby corrected as shown below:

Column 22,
Line 51, delete "(first".

Signed and Sealed this

Twenty-seventh Day of September, 2005

JON W. DUDAS
*Director of the United States Patent and Trademark Office*